US006934504B2

(12) United States Patent
Morita

(10) Patent No.: US 6,934,504 B2
(45) Date of Patent: Aug. 23, 2005

(54) IMAGE FORMING APPARATUS AND IMAGE FORMATION CONTROL METHOD

(75) Inventor: Tetsuya Morita, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/901,155

(22) Filed: Jul. 29, 2004

(65) Prior Publication Data

US 2005/0002712 A1 Jan. 6, 2005

Related U.S. Application Data

(63) Continuation of application No. PCT/JP03/00993, filed on Jan. 31, 2003.

(30) Foreign Application Priority Data

Feb. 6, 2002 (JP) ..... 2002-029764
Jan. 6, 2003 (JP) ..... 2003-000370

(51) Int. Cl.[7] ..... G03G 15/00
(52) U.S. Cl. ..... 399/394; 399/372; 399/195
(58) Field of Search ..... 399/394, 195, 399/301, 361, 372, 401; 347/129, 139, 234, 248, 252, 262

(56) References Cited

U.S. PATENT DOCUMENTS

| | | | | |
|---|---|---|---|---|
| 6,052,552 | A | 4/2000 | Ohsumi et al. | 399/394 |
| 6,342,909 | B1 * | 1/2002 | Joichi et al. | 347/129 |
| 6,477,352 | B2 * | 11/2002 | Takahashi et al. | 399/401 |
| 6,748,187 | B2 * | 6/2004 | Ishiwata | 399/195 |
| 2001/0002952 | A1 | 6/2001 | Sakai | 399/250 |

FOREIGN PATENT DOCUMENTS

| | | |
|---|---|---|
| EP | 0 590 533 A1 | 4/1994 |
| EP | 1 039 739 A2 | 9/2000 |
| JP | 63-175877 | 7/1988 |
| JP | 3-25461 | 2/1991 |
| JP | 5-35013 | 2/1993 |
| JP | 5-191580 | 7/1993 |
| JP | 6-291946 | 10/1994 |
| JP | 9-219776 | 8/1997 |
| JP | 2001-42708 | 2/2001 |
| WO | WO 03/067339 A1 | 8/2003 |

OTHER PUBLICATIONS

International Search Report for PCT/JP03/00993, mailed Mar. 11, 2003.
Notification of Transmittal of International Preliminary Examination Report and International Preliminary Examination Report, mailed Oct. 14, 2003.
Response to Written Opinion filed in connection with PCT/JP03/00993.

* cited by examiner

*Primary Examiner*—Minh Chau
(74) *Attorney, Agent, or Firm*—Fitzpatrick, Cella, Harper & Scinto

(57) ABSTRACT

A frame image (210) with 5-mm wide margins is formed on a paper sheet on the basis of the leading end and widthwise end positions of the paper sheet (107) detected by a contact image sensor (CIS) (204) in an adjustment mode. After that, this paper sheet (107) is circulated to a feed position via a circulating path (206) and paper convey path (205), and the CIS (204) detects the frame image position formed on the circulated paper sheet and its paper end portion so as to detect errors from the 5-mm wide margins. Correction values which can cancel these errors are stored in a correction parameter storage unit (71), and forming start timing control is made using these correction values upon forming an image in an actual job. In this way, an image forming apparatus which can detect the paper feed timing with high precision, can eliminate deterioration of the image position precision due to mounting errors and durability of components, and can always precisely adjust the image position is provided.

19 Claims, 16 Drawing Sheets

IMAGE FORMING APPARATUS AND IMAGE FORMATION CONTROL METHOD

TECHNICAL FIELD

The present invention relates to an image forming apparatus such as an LBP (laser beam printer), copying machine, or the like that uses, e.g., an electrophotographic technique.

BACKGROUND ART

A conventional image forming apparatus will be described below. FIG. 16 shows the structure of a print position adjustment mechanism in a conventional image forming apparatus. FIG. 16 shows a photosensitive drum 31, a laser device 202 which forms a latent image on the photosensitive drum 31, a registration clutch (to be also referred to as registration rollers hereinafter) 203 which determines the paper feed timing, a paper sensor 1204 for detecting a paper sheet to be conveyed, a deviation amount detection sensor 1205 which detects the deviation amount of the widthwise end in a direction (to be also referred to as a widthwise direction hereinafter) perpendicular to the paper feed direction, an output paper sheet 107, and a paper convey path 205.

In the print position adjustment mechanism of the conventional image forming apparatus with the above arrangement, a control circuit (not shown) detects the deviation amount of a paper sheet in its widthwise direction using the deviation amount detection sensor 1205, and detects the paper position in the paper feed direction using the paper sensor 1204. Furthermore, the control circuit adjusts the transfer timing of image data to a laser control circuit (not shown) that drives the laser device 202, and the paper feed timing of the registration clutch 203 on the basis of these pieces of acquired information.

Furthermore, the control circuit sets the image forming start position (laser irradiation start position) of the laser device 202, and checks any skew of a paper sheet on the basis of at least two widthwise end positions of the paper sheet detected by the deviation amount detection sensor 1205 to make error display and the like (e.g., Japanese Patent Laid-Open No. 9-219776)

However, in the conventional image forming apparatus, the image position precision in the paper feed (convey) direction is dominantly determined by the coupling time of the registration clutch. Especially, when a high-speed print process is done, the image position precision deteriorates in proportion to the print speed due to the coupling time of the registration clutch.

When a high-speed print process is done, the image position precision also deteriorates due to some detection error of the paper feed timing by the sensor, mechanical attachment errors and durability of components, and the like.

It is, therefore, an object of the present invention to provide an image forming apparatus and image formation control method, which can detect the paper feed timing with high precision, can eliminate any drop of the image position precision due to mechanical attachment errors and durability of components, and can precisely adjust the image position all the time.

DISCLOSURE OF INVENTION

It is an object of the present invention to provide an image forming apparatus, which can detect the paper feed timing with high precision, can eliminate any drop of the image position precision due to mechanical attachment errors and durability of components, and can precisely adjust the image position all the time.

In order to achieve the above object, according to the first aspect of the present invention, an image forming apparatus is characterized by comprising: an image forming unit for forming an image on a sheet; registration rollers for conveying the sheet to the image forming unit at a predetermined timing; a sheet reading unit which has a plurality of reading pixels used to read an image on the sheet, and is arranged on a passage region of the sheet between the image forming unit and the registration rollers so that the plurality of reading pixels line up in a widthwise direction of the sheet; a leading end detector for detecting a leading end of the sheet by repetitively reading out the plurality of pixels at a predetermined period; a start timing determination unit for determining a start timing of image formation of the image forming unit on the basis of the leading end of the sheet detected by the leading end detector; a re-convey unit for making the image forming unit form a predetermined image on the sheet in accordance with the start timing of image formation determined by the start timing determination unit, and re-conveying the sheet formed with the predetermined image to the image forming unit; an image position detector for detecting a predetermined image position formed on the sheet re-conveyed by the re-convey unit by reading out the reading pixels of the sheet reading unit; a correction value calculation unit for calculating a correction value of the start timing of image formation in the convey direction on the basis of the image position detected by the image position detector; and a forming start position adjustment unit for adjusting a position of an image to be formed on the sheet by the image forming unit by correcting the start timing of image formation in the convey direction on the basis of the correction value calculated by the correction value calculation unit.

According to the above arrangement, since the position of a paper sheet and the image position are detected with high precision on the basis of data read out from the sheet read unit which has a plurality of pixels in the widthwise direction with respect to the paper convey direction, position adjustment upon image formation can be precisely done.

In order to achieve the above object, according to the second aspect of the present invention, an image forming apparatus is characterized by comprising: an image forming unit for forming an image of a document on a sheet; registration rollers for conveying the sheet to the image forming unit at a predetermined timing; a sheet reading unit which has a plurality of reading pixels used to read an image on the sheet, and is arranged on a passage region of the sheet between the image forming unit and the registration rollers so that the plurality of reading pixels line up in a widthwise direction of the sheet; a leading end detector for detecting a leading end of the sheet by repetitively reading out the plurality of pixels at a predetermined period; a start timing determination unit for determining a start timing of image formation of the image forming unit on the basis of the leading end of the sheet detected by the leading end detector; a widthwise end detector for detecting a widthwise end of the sheet by repetitively reading out the plurality of reading pixels read out by the leading end detector; a forming start position determination unit for determining a forming start position of the image in a direction perpendicular to a convey direction of the sheet by the image forming unit on the basis of the detected widthwise end of the sheet; a re-convey unit for making the image forming unit form a predetermined image on the sheet in accordance with the determined start timing of image formation, and the determined forming start position of the image, and re-conveying the sheet formed with the predetermined image to the image forming unit, an image position detector for detecting a predetermined image position formed on the sheet re-conveyed by-the re-convey unit by reading out the reading pixels of the sheet reading unit; a correction value calculation unit for calculating a correction value of the forming start position of the image on the basis of the image position detected by the image position detector; and a forming start position adjustment unit for adjusting a position of an image to be formed on the sheet by the image forming unit by correcting the forming start position of the image in the vertical direction on the basis of the correction values calculated by the correction value calculation unit.

According to the above arrangement, since an image is recorded on a paper sheet in consideration of the detected correction value as mounting error data of the sheet read unit in addition to the leading end detection data or widthwise end detection data, the need for calculating correction parameters for each correction can be obviated, and image recording with very high positional precision can be assured.

Since the image recording position precision can be improved in both the main scan and sub-scan directions, image formation with precise image recording positions in both the main scan and sub-scan directions can be achieved.

The above and other objects, features, and advantages of the invention will become more apparent from the following detailed description taken in conjunction with the accompanying drawings.

BEST MODE OF CARRYING OUT THE INVENTION

Figure 1:
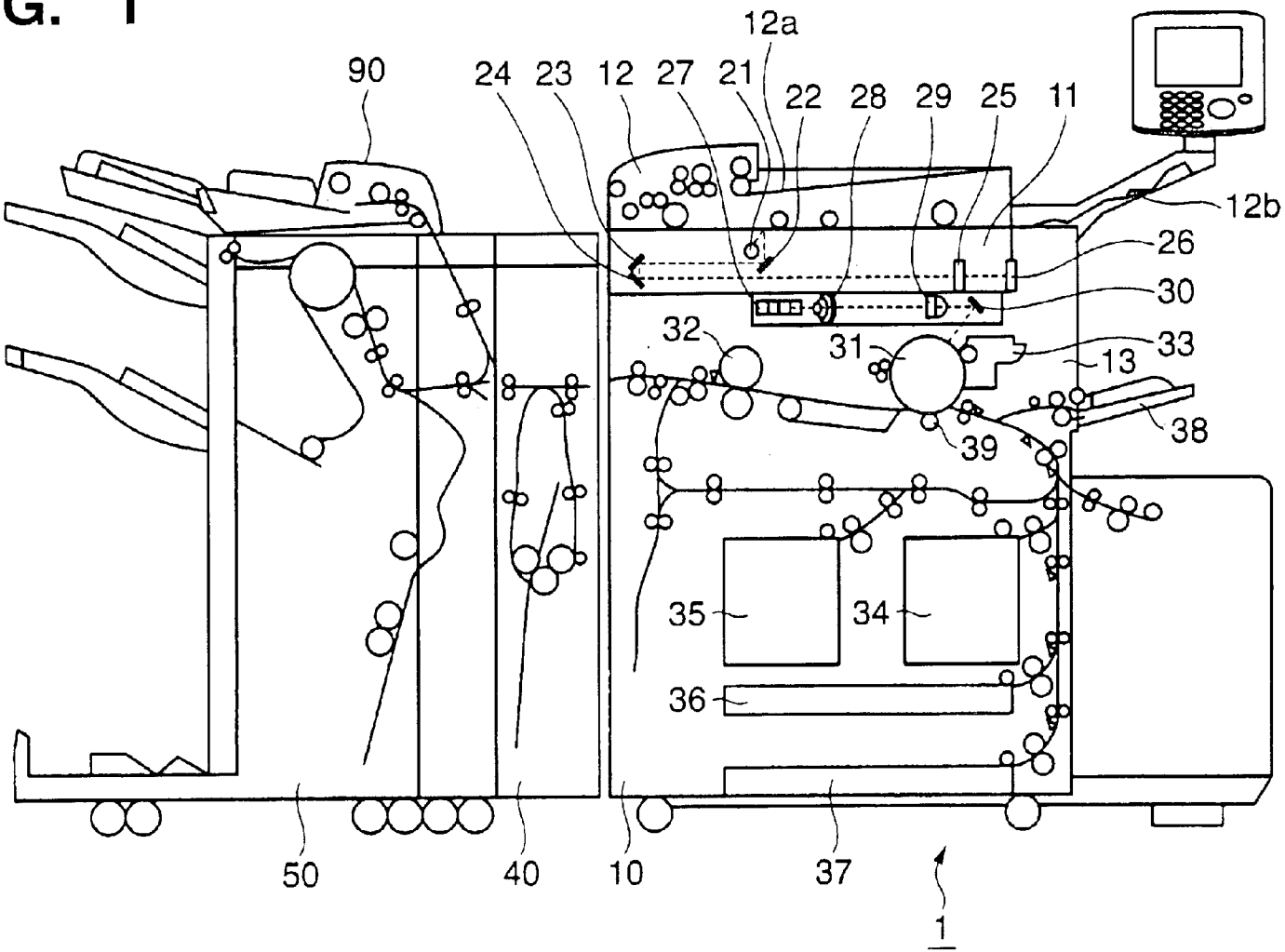
FIG. 1 is a view showing the structure of an image forming apparatus according to an embodiment.

An embodiment of an image forming apparatus and its control method according to the present invention will be described in detail hereinafter with reference to the accompanying drawings. Note that building components described in this embodiment are merely examples, and do not limit the scope of this invention. The same reference numerals denote the same parts throughout the drawings, and a repetitive description thereof will be avoided.

[Overall Arrangement]

FIG. 1 is a view showing the structure of an image forming apparatus 1 according to an embodiment of the present invention. This image forming apparatus 1 is comprised of an image forming apparatus main body 10, folding device 40, and finisher 50. The image forming apparatus main body 10 is comprised of an image reader 11 for reading a document image, and a printer 13.

A document feeder 12 is mounted on the image reader 11. The document feeder 12 feeds documents, which are set facing up on a document tray 12*a*, one by one in turn from the first page to the left in FIG. 1, conveys a document onto a platen glass via a curved path, and stops it at a predetermined position. In this state, the document feeder 12 scans a scanner unit 21 from the left to the right to read a document image. After the image is read, the document feeder 12 exhausts the document toward an external exhaust tray 12*b*.

A surface to be read of a document is irradiated with light coming from a lamp in the scanner unit 21, and light reflected by that document is guided to a lens 25 via mirrors 22, 23, and 24. The light which has been transmitted through the lens 25 forms an image on an image sensing surface of an image sensor 26.

Then, the scanner unit 21 is conveyed in the sub-scan direction while reading a document image by the image sensor 26 for respective lines in the main scan direction, thereby scanning the entire document image. The optically read image is converted by the image sensor 26 into image data, which is to be output. The image data output from the image sensor 26 undergoes a predetermined process in an image signal controller (image processing circuit; not shown), and is then input to an exposure controller (laser control circuit; not shown) of the printer 13 as a video signal.

The exposure controller of the printer 13 modulates a laser beam output from a laser element (not shown) on the basis of the input image data, and the modulated laser beam strikes the surface of a photosensitive drum 31 via lenses 28 and 29 and a mirror 30 while being scanned by a polygonal mirror 27.

An electrostatic latent image is formed on the surface of the photosensitive drum 31 in accordance with the scanned laser beam. The electrostatic latent image on the photosensitive drum 31 is visualized as a toner image by a toner supplied from a developer 33. A paper sheet is fed from a cassette 34, 35, 36, or 37, a manual insert unit 38, or a double-sided convey path at a timing synchronized with the start of irradiation of the laser beam, and is conveyed to an image forming unit via registration rollers.

This paper sheet is conveyed to the nip between the photosensitive drum 31 and a transfer roller 39, and the toner image formed on the photosensitive drum 31 is transferred onto the fed paper sheet by the transfer roller 39. The paper sheet on which the toner image has been transferred is conveyed to a fixing unit 32, which fixes the toner image on the paper sheet by thermally pressing the paper sheet. The paper sheet which has left the fixing unit 32 is exhausted from the printer 13 externally (toward the folding device 40) via a flapper and exhaust rollers.

When the paper sheet is to be exhausted with its image forming surface facing down (face down state), the paper sheet which has left the fixing unit 32 is temporarily guided into a reverse path by the switching operation of the flapper. After the trailing end of that paper sheet has passed the flapper, the paper sheet is switched back and is exhausted from the printer 13 via the exhaust rollers.

When a hard sheet such as an OHP sheet or the like is fed from the manual insert unit 38, and an image is to be formed on this sheet, the sheet is exhausted via the exhaust rollers with its image forming surface facing up (face up state) without being guided to the reverse path.

Furthermore, when a double-sided recording mode that forms images on two surfaces of a paper sheet is set, the paper sheet is guided to the reverse path by the switching operation of the flapper, and is then conveyed to the double-sided convey path. The paper sheet which has been conveyed to the double-sided convey path is fed again to the nip between the photosensitive drum 31 and transfer unit at the aforementioned timing.

The paper sheet exhausted from the printer 13 is fed to the folding device 40. This folding device 40 folds the paper sheet in a Z shape. For example, when an A3- or B4-sized sheet is selected, and a folding process is designated, such sheet undergoes the folding process by the folding device 40; otherwise, the paper sheet exhausted from the printer 13 is fed to the finisher 50 through the folding device 40. The finisher 50 includes an inserter 90 for feeding special sheets such as cover sheets, inserting sheets, and the like to be inserted into paper sheets formed with images. The finisher 50 executes various processes such as a bookbinding process, binding process, punching process, and the like.

Note that the photosensitive drum is used as an image carrier of the image forming apparatus, but a photosensitive belt may be used instead.

[Paper Feed Timing and Image Forming Start Timing]

Figure 2:
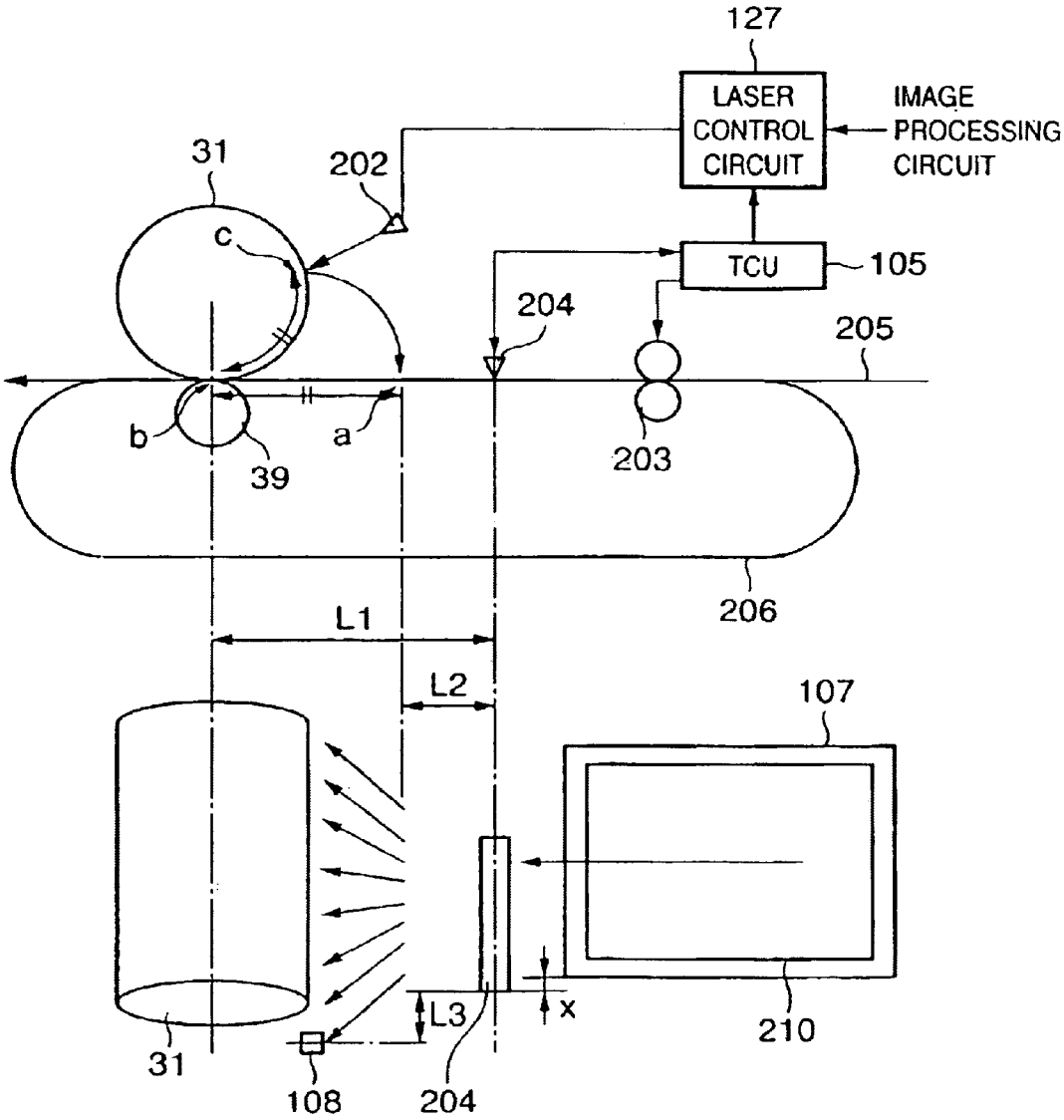
FIG. 2 is a view showing a print position adjustment mechanism which is arranged along a paper convey path which extends to a photosensitive drum.

FIG. 2 is a view showing a print position adjustment mechanism arranged along a paper convey path extending to the photosensitive drum. FIG. 2 illustrates a paper convey path 205, the aforementioned photosensitive drum 31, and a laser element 202 used to form a latent image on the photosensitive drum 31. Note that the laser element 202 is illustrated at a position for the purpose of convenience, and that position is different from an actual one. A paper sheet which is fed along the paper convey path 205 temporarily abuts against paper convey rollers (registration rollers) 203 to stay there, and is then fed toward the photosensitive drum 31 by the registration rollers 203 in synchronism with a predetermined paper feed timing. Reference numeral 204 denotes an image reading sensor (image sensor), which is used to read an image to detect the sheet position and comprises a photoelectric conversion element array such as a CCD, CIS, or the like. This embodiment adopts the CIS (contact image sensor). This CIS 204 is separated a distance L1 (see FIG. 2) from a transfer point b between the photosensitive drum 31 and transfer roller 39 in the direction of the registration rollers 203.

Also, the CIS 204 is separated a distance L2 from an image forming point (point a; to be described later) in the direction of the registration rollers 203. Furthermore, the CIS 204 is separated a distance L3 from a BD detector 108 (to be described later) in its widthwise direction. The beam detect (BD) detector 108 detects the irradiation timing of the laser element (to be simply referred to as a laser hereinafter) 202. A laser beam hits the BD detector 108 via the polygonal mirror, and is then scanned to hit the photosensitive drum 31, thus forming a latent image on the photosensitive drum 31.

In FIG. 2, point a indicates an image forming point. For example, when image formation is done by the laser device 202 at a timing at which the paper sheet has passed 5 mm the point a, rotation of the photosensitive drum 31 and conveyance of a paper sheet 107 are synchronously made, and an output image is consequently formed at a 5-mm position from the leading end of the paper sheet.

Also, in FIG. 2, point b indicates a transfer point, and point c indicates a forming start point. When a latent image is formed by the laser 202 on the photosensitive drum 31 at the forming start point C, toner is transferred onto the paper sheet at the transfer point b via a developing unit, thus attaining image formation.

Upon this image formation, when the paper sheet 107 fed from the registration roller 203 is conveyed toward the photosensitive drum 31 along the paper convey path 205, and goes the distance L2 after its leading end is detected by the CIS 204, control is made to irradiate the photosensitive drum 31 with the laser beam. More specifically, a timer counts a time, which is required for the paper sheet 107 to go the distance L2, and when that time has elapsed, the photosensitive drum 31 is irradiated with the laser beam.

Furthermore, in order to precisely adjust the forming start position (laser irradiation start position), the forming start timing in a paper feed direction (to be referred to as a sub-scan direction for the sake of convenience) of the paper sheet, and the forming start timing in a direction (to be referred to as a main scan direction for the sake of convenience) perpendicular to the paper feed direction must be detected, and the forming start timing of the laser beam must be controlled in accordance with the detected information.

That is, the start timing of image formation is determined after the CIS 204 detects the leading end position of the paper sheet, and a forming process starts after the paper sheet goes the distance L2, thereby adjusting the image forming start position in the sub-scan direction. Therefore, the distance L2 must have at least a distance corresponding to a time required from when the CIS 204 detects the leading end of the paper sheet 107 until deviations of the paper sheet in its feed and widthwise directions are detected, and the forming start timings in these directions are set. In a normal image forming apparatus, the paper convey speed is set to be equal to the rotational speed of the photosensitive drum 31. This means that a distance L1–L2 from the position (image forming point a) where the paper sheet has gone the distance L2 from the CIS 204 to the transfer position (transfer point b) to a sheet as the nip position between the transfer roller 39 and photosensitive drum 31 is equal to the circumferential (peripheral) distance on the photosensitive drum 31 from the laser forming start position (forming start point c) to the transfer position (transfer point b) to a sheet.

When the CIS 204 detects the widthwise end position (widthwise registration) of the paper sheet, a distance (x+L3) is calculated by adding the distance L3 from the beam detector (BD) 108 to the lower end of the CIS 204 to a distance x from the lower end of the CIS 204 to the widthwise end position of the paper sheet, and a laser forming process starts when the laser beam is scanned the calculated distance in the main scan direction after the beam detector 108 detects the laser beam, thereby adjusting the image forming start position in the main scan direction. Note that the forming start timings in the main scan and sub-scan directions can be respectively arbitrarily changed in accordance with a position where an image is to be formed, i.e., the distances from the end portion in the widthwise direction and the leading end of the paper sheet.

Such adjustment of the image forming start positions of the laser beam in the sub-scan and main scan directions is done by a timing control unit (TCU) 105 to be described later. That is, the TCU 105 turns on the registration rollers 203 to make them start conveyance of the paper sheet, and then outputs the forming start timing to a laser control circuit 127 on the basis of the detection signal from the CIS 204. The laser control circuit 127 drives the laser element 202 on the basis of image data sent from an image processing circuit (not shown) in synchronism with the forming start timing output from the TCU 105.

[Arrangement of CIS]

Figure 3:
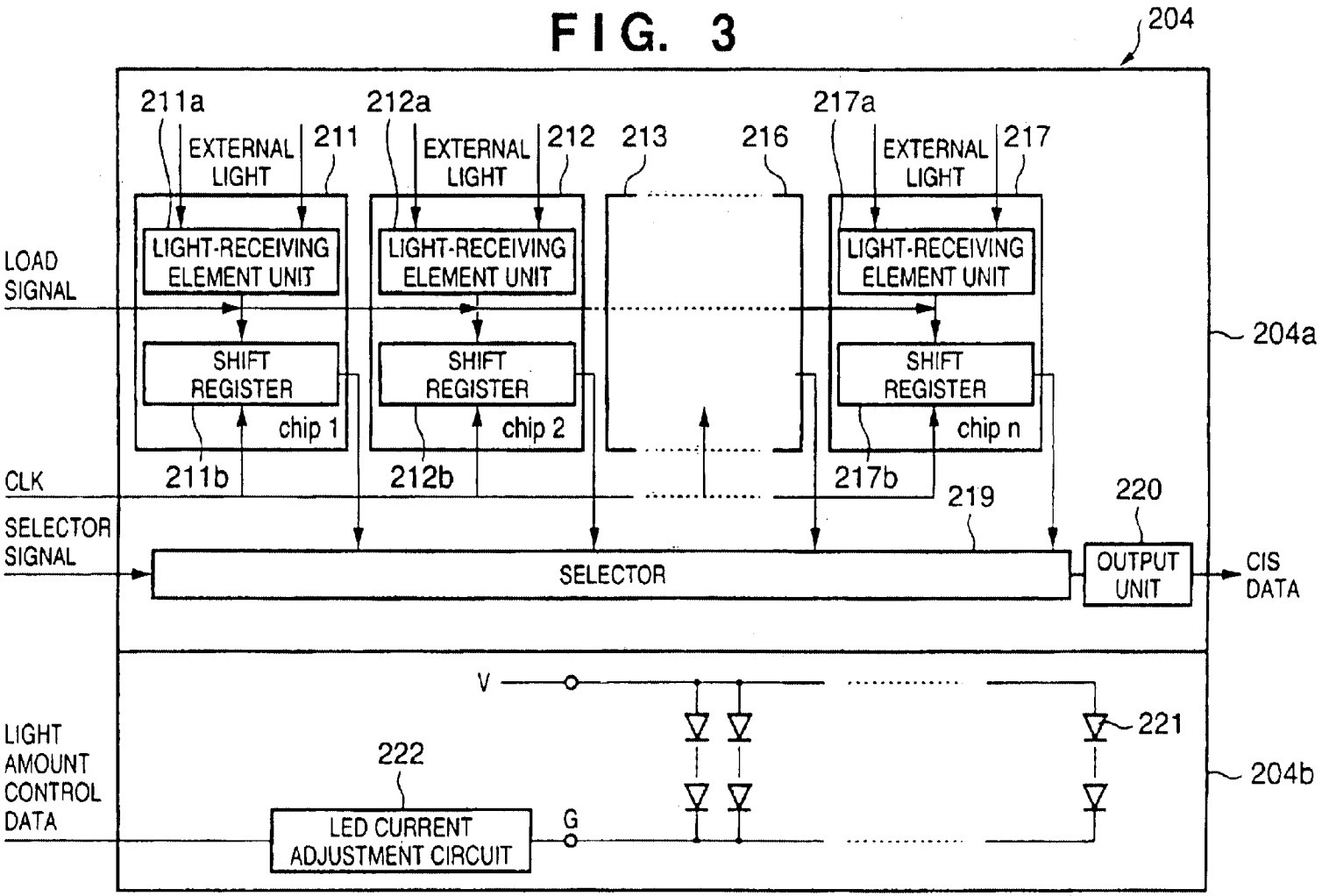
FIG. 3 is a block diagram showing the arrangement of a CIS 204.

FIG. 3 is a block diagram showing the arrangement of the CIS 204. This CIS 204 comprises an image reading unit 204*a* and LED emission unit 204*b*. The image reading unit 204*a* comprises a plurality of chips (1 to n) 211 to 217 each of which houses a light-receiving element unit and shift register, selector 219, and output unit 220. In this embodiment, the number of chips is 7 (n=7). The light-receiving element unit in each chip includes 1000 reading pixels.

Of 7000 (the number of effective pixels) reading pixels of the CIS as a whole, 1000 reading pixels in the first chip (1) 211 are used to read in the sub-scan direction (leading end & skew detection to be described later). On the other hand, 6000 reading pixels in the remaining six chips (2 to 6) 212 to 216 are used to read in the main scan direction (widthwise end detection to be described later). Note that the number of effective pixels as a total of the plurality of chips is an example, and is not particularly limited but may be arbitrarily set. Also, the number of chip divisions is not limited to 1:(n-1) of this embodiment, but may be arbitrarily set.

In the image reading unit 204*a*, when the selector 219 selects a specific chip, e.g., only the chip 211 used in leading end & skew detection, as an effective chip on the basis of a selector signal from the TCU 105, an image signal detected by a light-receiving element unit 211*a* is temporarily read out to a shift register 211*b* in response to a load signal (CIS-SH) from the TCU 105, and is then sequentially transferred from the shift register 211*b* to the output unit 220 via the selector 219 in accordance with clocks (CLK) from the TCU 105. The output unit 220 converts the transferred serial image signal into parallel data, and outputs the parallel data as CIS data.

When the selector 219 selects the chips 212 to 217 used in widthwise end detection as effective chips on the basis of a selector signal from the TCU 105, image signals detected by light-receiving element units 212*a* to 217*a* are temporarily read out to shift registers 212*b* to 217*b* in response to a load signal from the TCU 105, and are then sequentially transferred from the shift registers 212*b* to 217*b* to the output unit 220 via the selector 219 in accordance with clocks (CLK) from the TCU 105. The output unit 220 converts the transferred serial image signals into parallel data, and outputs the parallel data as CIS data.

On the other hand, the LED emission unit 204*b* comprises an LED unit 211 in which a plurality of serial circuits of LED groups are connected in parallel with each other, and an LED current adjustment circuit 222 which is connected to the cathode side of the respective LED groups, and adjusts currents supplied to the respective LED groups. The LED current adjustment circuit 222 adjusts the overall LED emission amount of the LED unit 221 in accordance with light amount control data from the TCU 105.

Figure 4:
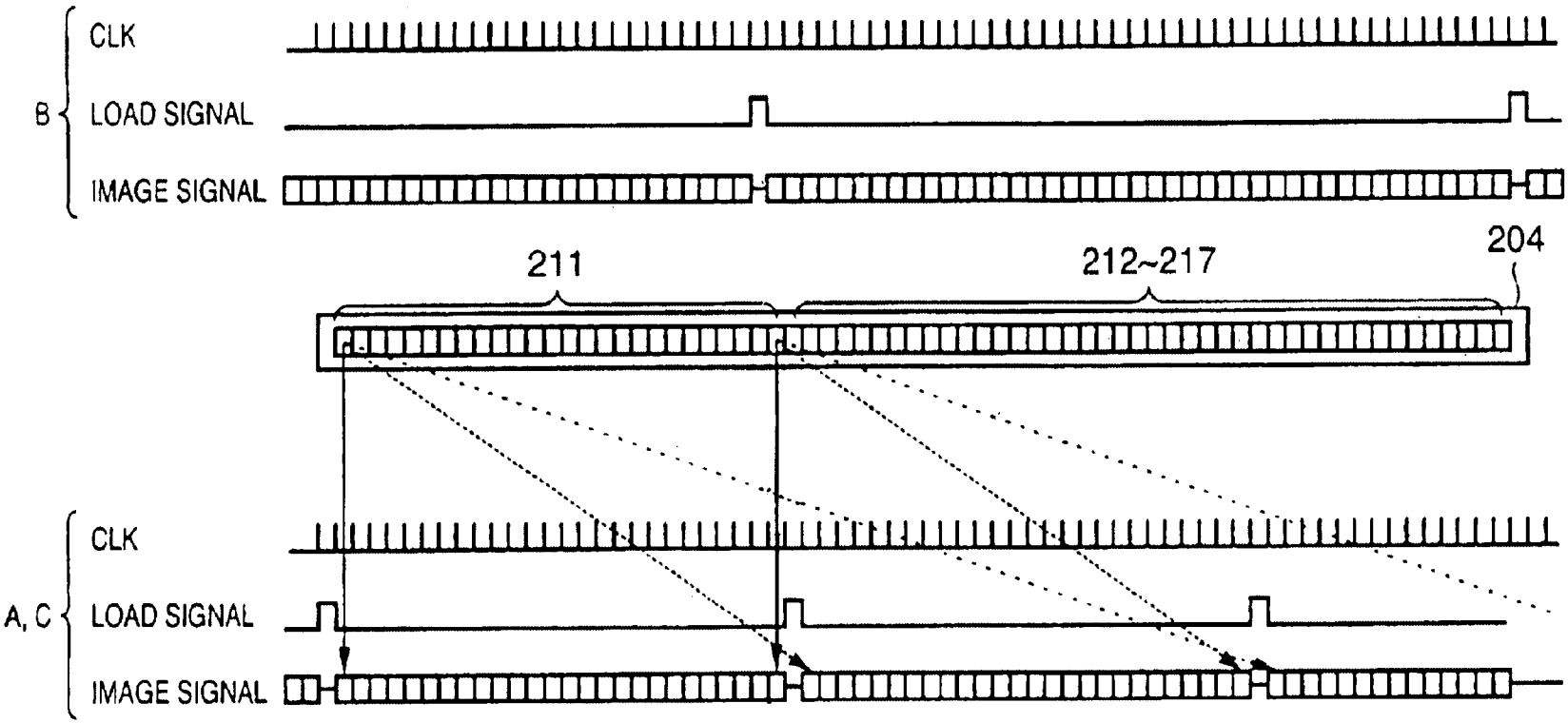
FIG. 4 is a timing chart showing changes in clock (CLK), load signal (CIS-SH), and image signal of the CIS 204 upon leading end detection, skew detection, and widthwise end detection.

FIG. 4 is a timing chart showing changes in clock (CLK), load signal (CIS-SH), and image signal of the CIS 204 upon leading end detection, skew detection, and widthwise end detection. In case of leading end detection and skew detection (A and C in FIG. 4), the light-receiving element unit 211*a* to be used corresponds to one chip, and a charge accumulation time determined by repetitively reading out an image signal in response to a load signal becomes short. In this case, a high LED current value of the LED current adjustment circuit 222 is set by the light amount control data from the TCU 105 so as to increase the LED emission amount, thereby preventing a drop of the S/N ratio of a read image. On the other hand, in case of the widthwise end detection (B in FIG. 4), the six light-receiving element units 212*a* to 217*a* are used, and a charge accumulation time determined by repetitively reading out image signals in response to a load signal becomes relatively long.

In this case, even when a low LED current value of the LED current adjustment circuit 222 is set by the light amount control data from the TCU 105 to decrease the LED emission amounts a high S/N ratio of a read image can be maintained.

Figure 5:
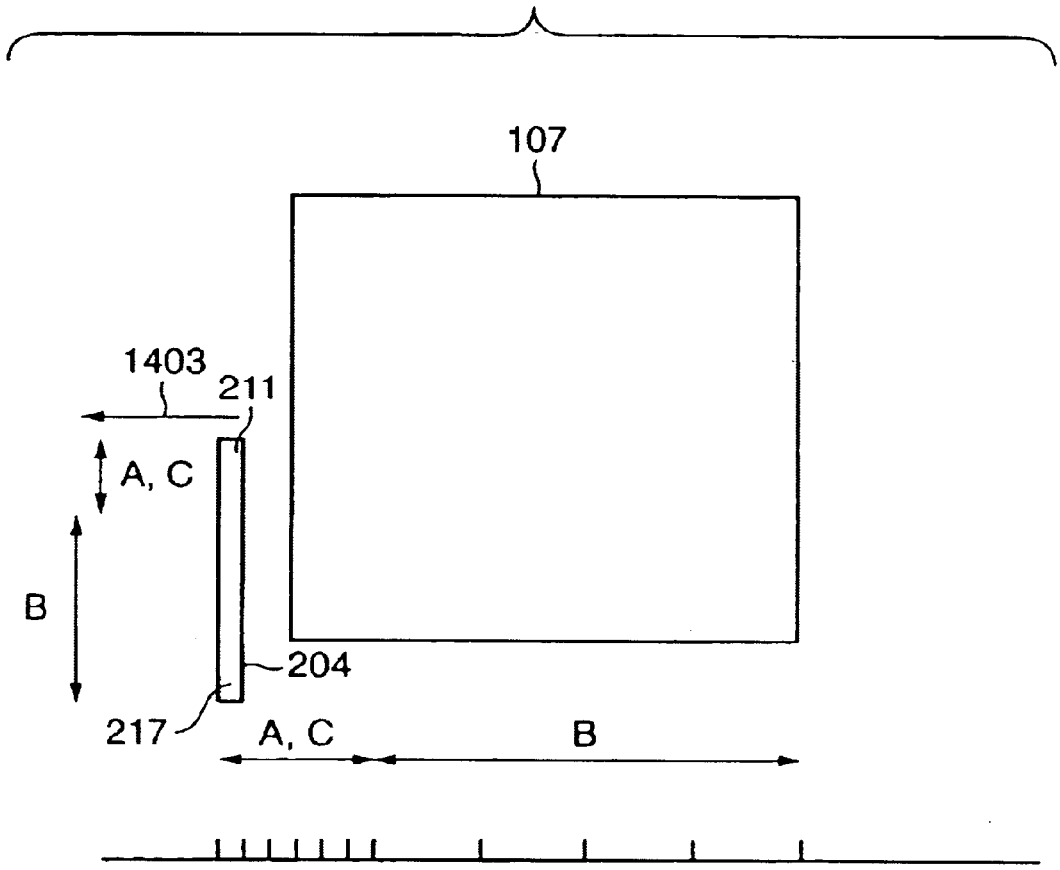
FIG. 5 is a view showing the layout of the CIS 204 with respect to a paper passage region.

FIG. 5 is a view showing the layout of the CIS 204 with respect to a passage region of a paper sheet. The CIS 204 is arranged so that reading pixels line up in the widthwise direction of the paper sheet 107. In addition, the CIS 204 is arranged so that one end of the CIS 204 matches nearly the central position of the passing paper sheet 107, and the other end matches a position beyond the widthwise end of the passing paper sheet 107. On the CIS 204, the chip (1) 211 is located on nearly the central side of the paper sheet 107, and the chip (7) 217 is located on-the side beyond the widthwise end.

Figure 6:
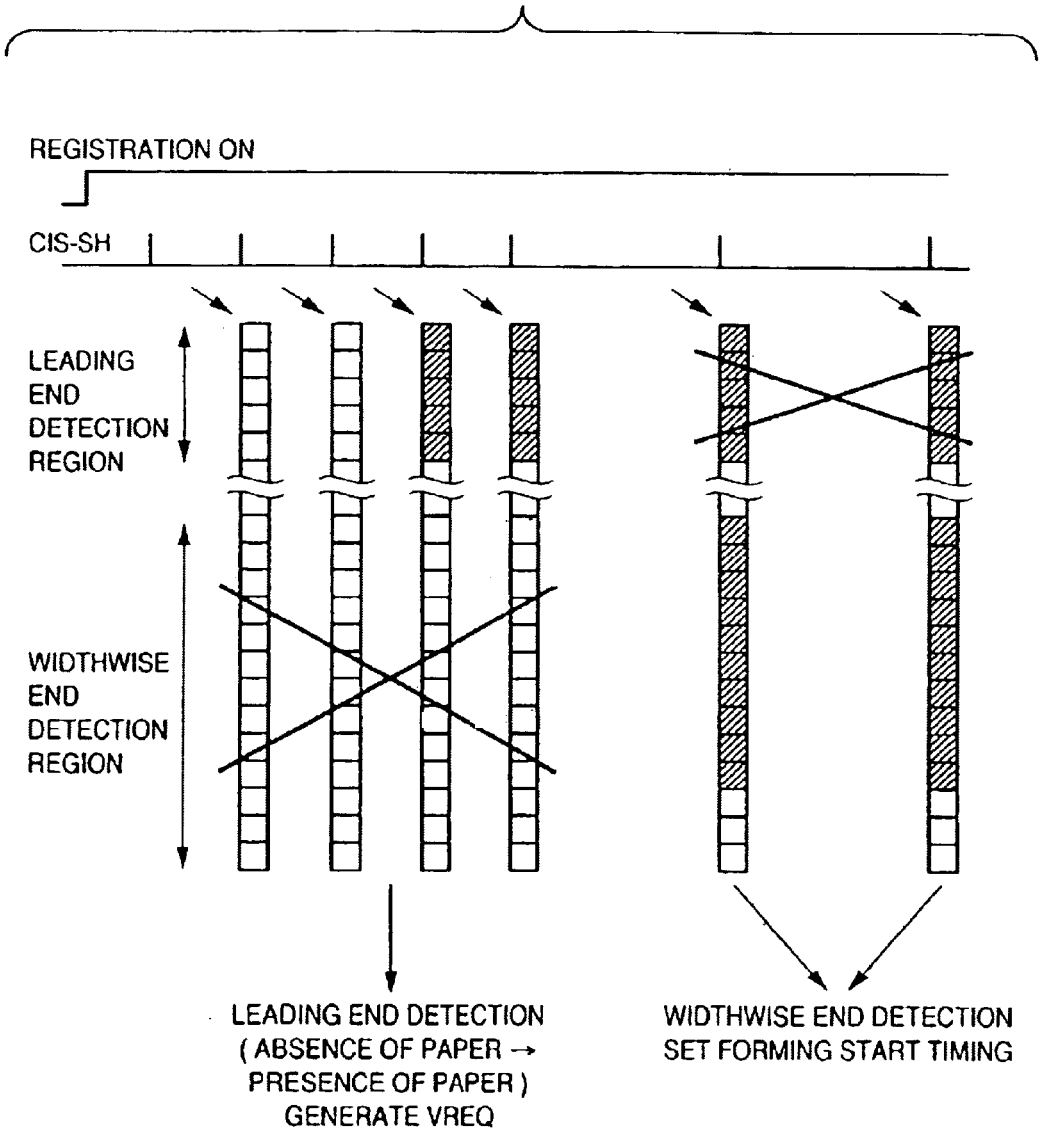
FIG. 6 is a view showing a leading end detection region and widthwise end detection region in the CIS 204.

FIG. 6 is a view showing a leading end detection region and widthwise end detection region in the CIS 204. As described above, the leading end (skew) detection region corresponds to 1000 pixels included in the light-receiving element unit 211*a* in the CIS 204, which is located on nearly the central side of the paper sheet 107. During the leading end (skew) detection, the remaining reading pixels in the CIS are not used (indicated by x in the left side of FIG. 6). On the other hand, the widthwise end detection region corresponds to 6000 pixels included in the remaining light-receiving element units 212*a* to 217*a* in the CIS 204. During the widthwise end detection, 1000 pixels in the light-receiving element unit 211*a* used in the leading end detection are not used (indicated by x in the right side of FIG. 6).

In this manner, upon executing the leading end detection and widthwise end detection, a process for fetching only required pixel data of reading pixels of the CIS 204, which is suitable for each detection, is executed so as not to fetch data which are not required for that detection as much as possible.

Figure 7:
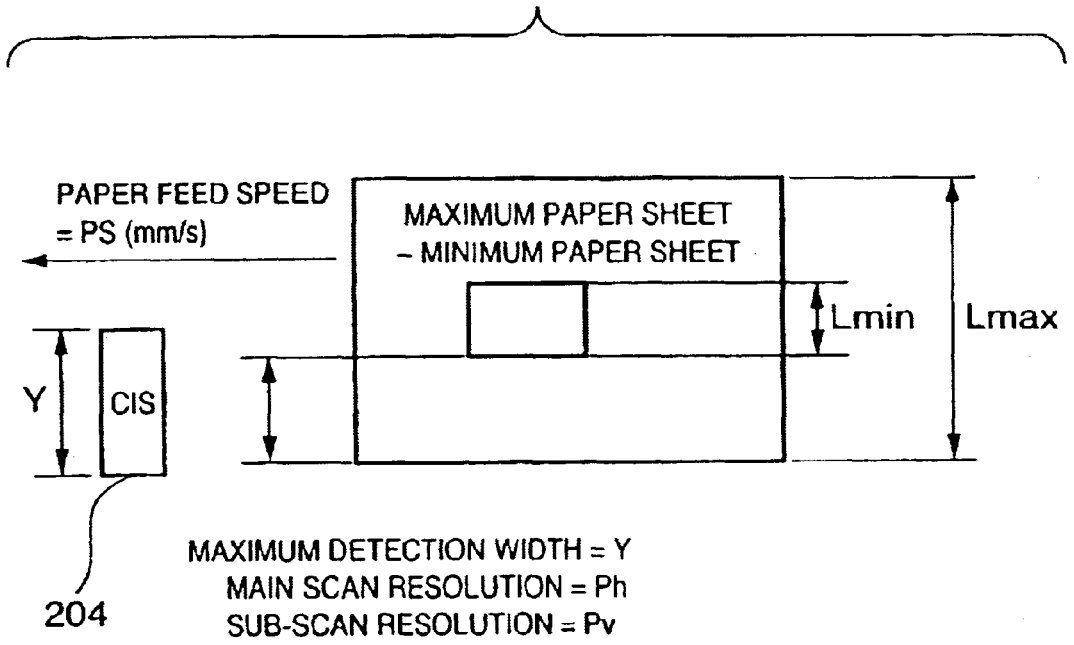
FIG. 7 is a view showing the maximum detection width of the CIS 204.

FIG. 7 is a view showing the maximum detection width of the CIS 204. Let Lmax be a maximum sheet width used in the image forming apparatus, and Lmin be a minimum sheet width. Then, a maximum detection width Y is nearly equal to ½(Lmax−Lmin) and, as can be seen from this, the CIS 204 having such maximum detection width Y can be used.

Serviceability when the CIS is used in the leading end (skew) detection will be explained below. For example, if the paper feed speed (PS) is 800 mm/s, the maximum detection width (Y) is 100 mm, the main scan and sub-scan resolutions Ph and Pv are respectively 0.05 mm, the reading period per line of the sensor=PS/Pv=16 kHz, and the number of sensor pixels=Y/Ph=2000 dots. In a normal sensor use method, VCLK=16 kHz*2000 dots=32 MHz. That is, a sensor which can operate at 32 MHz is required.

However, in a method described in this embodiment, if the number of pixels used to read in the sub-scan direction is reduced to 1/10, i.e., 200 dots, VCLK=16 kHz*200 dots=3.2 MHz. That is, a sensor which can operate at 3.2 MHz can be used, and an inexpensive CIS can be used. Upon reading in the main scan direction, since clocks VCLK are set at 3.2 MHz, detection can only be made once per 10 lines, but slow detection is allowed since widthwise end detection is to be made.

Since a plurality of pixels arranged in the main scan direction are used as pixel data to be used in the leading end detection and skew detection, no leading end detection sensor is required compared to a conventional single optical sensor or mechanical paper detection sensor, and the image forming apparatus can be made more compact by reducing the number of parts.

Since the widthwise end detection is made after the leading end detection and skew detection, different methods can be adopted as these detection methods. By adopting detection methods suitable for these detection modes, the detection precision can be improved.

Especially, use of data of some pixels in the main scan direction contributes to improvement of the detection precision. This is because the read period can be shortened and the pixel data density in the paper convey direction can be increased compared to a case wherein all pixels are read at the same read clocks, thus consequently improving the detection precision.

Although the leading end of a sheet is detected first by the CIS in terms of a sequence, if the leading end detection and widthwise end detection are simultaneously executed without processing the leading end detection of the sheet first, all pixels of the CIS must be read to attain widthwise end detection, and the leading end detection period is prolonged. For this reason, precise leading end detection is disturbed. Therefore, the aforementioned order of processes, i.e., the leading end detection (skew detection) and then widthwise end detection, assures leading end detection with higher precision.

Furthermore, since the leading end detection and widthwise end detection are executed independently, since the detection periods of these detection processes can be set to be shortest, a convey distance corresponding to the spacing between the registration rollers and image forming unit can be shortened, thus making the apparatus compact.

[Arrangement of Control Circuit]

Figure 8:
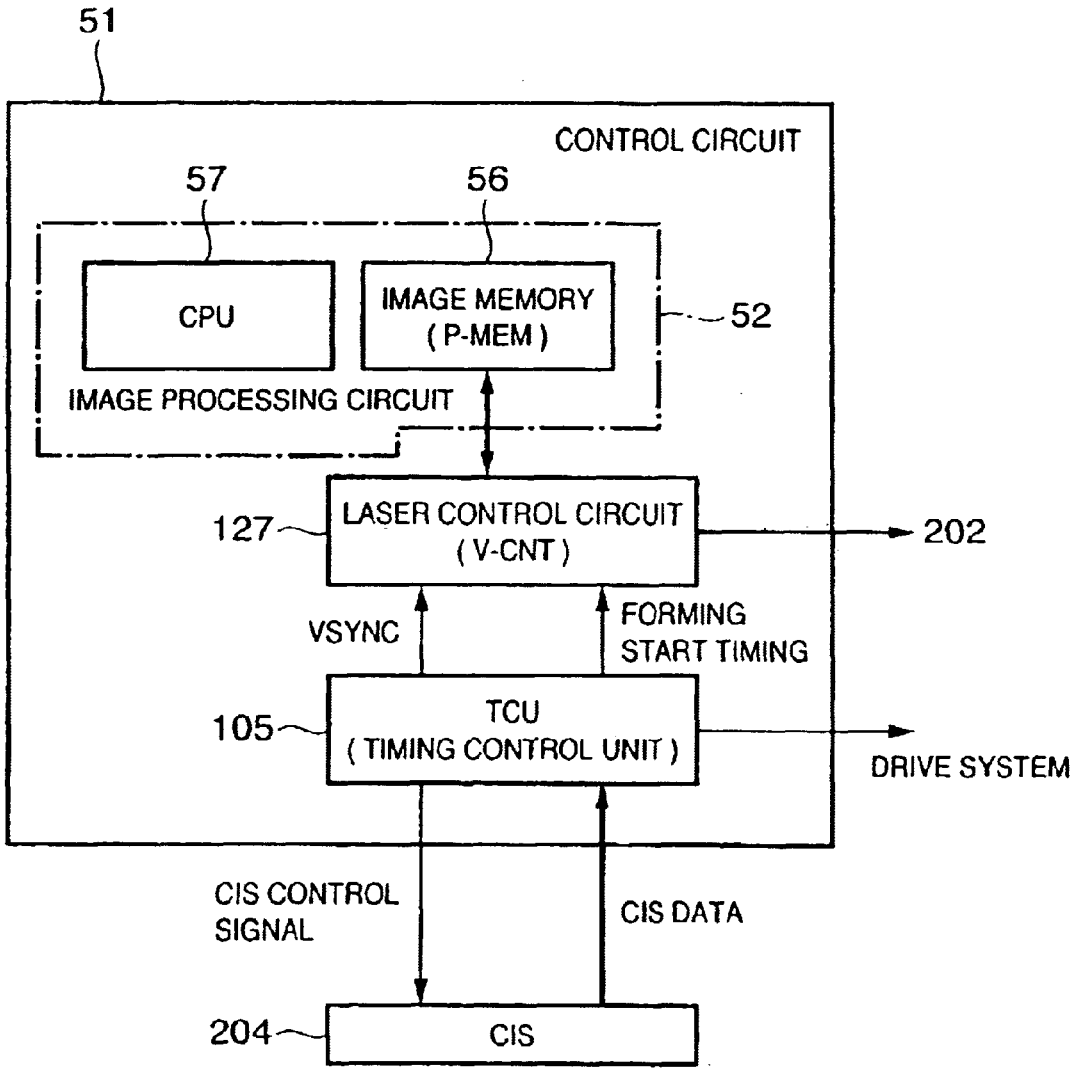
FIG. 8 is a block diagram showing the arrangement of a control circuit.

FIG. 8 is a block diagram showing the arrangement of a control circuit. A control circuit 51 has an image processing circuit 52, a laser control circuit (V-CNT) 127, and the timing control unit (TCU) 105. The image processing circuit 52 includes an image memory (P-MEM) 56 that stores image data read by the image sensor 26, and a CPU 57 for processing image data stored in this image memory 56.

The laser control circuit 127 outputs a drive signal to the laser element 202 on the basis of a signal output from the image processing circuit 52 in accordance with image data. The drive signal is output to the laser element 202 in synchronism with a timing signal from the TCU 105. The TCU 105 outputs a CIS control signal to the CIS 204, receives CIS data read by the CIS 204, and outputs the timing signal to the laser control circuit 127 on the basis of this CIS data. The timing signal includes forming start signals such as a vertical sync signal VSYNC, clocks VCLK, and horizontal sync signal HSYNC, a signal (registration ON signal) for driving the registration rollers 203, and the like.

Figure 9:
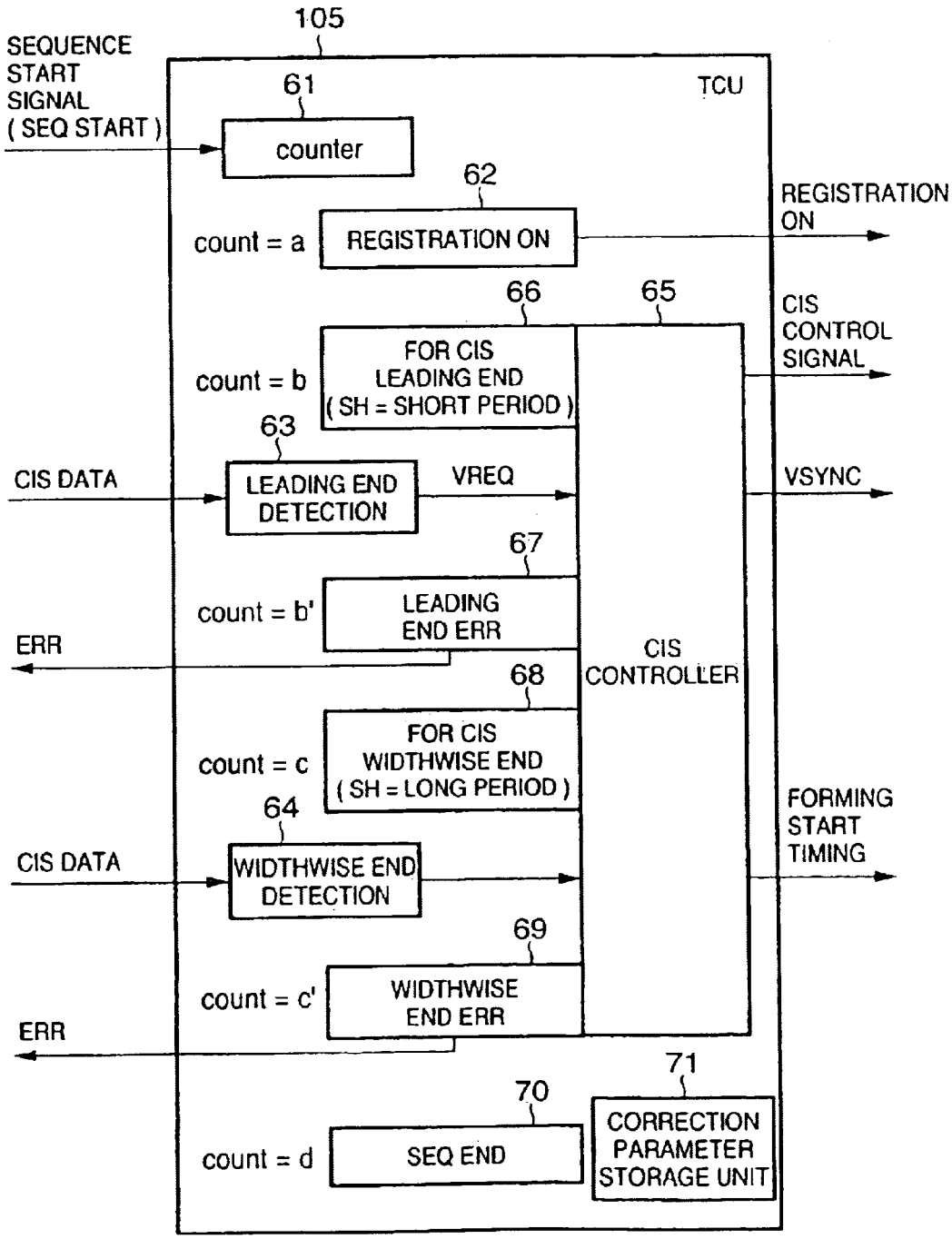
FIG. 9 is a block diagram showing the arrangement of a TCU 105.

FIG. 9 is a block diagram showing the arrangement of the TCU 105. The TCU 105 has a counter 61, registration ON unit 62, leading end detector 63, widthwise end detector 64, CIS controller 65, CIS leading end detection short period setting unit 66, leading end error detector 67, CIS widthwise end detection long period setting unit 68, widthwise end error detector 69, sequence end setting unit (SEQEND) 70, and correction parameter storage unit 71.

The counter 61 starts in response to a sequence start signal (SEQSTART), and counts clocks for a predetermined period. The registration ON unit 62 turns on/off driving of the registration rollers 203. The leading end detector 63 detects the leading end position of a paper sheet on the basis of CIS data input from the CIS 204. The widthwise end detector 64 similarly detects the widthwise end position of a paper sheet on the basis of CIS data input from the CIS 204.

The CIS controller 65 outputs a CIS control signal which includes a load signal (CIS-SH), clocks (CIS-CLK), selector signal, light amount control data, and the like. The CIS leading end detection short period setting unit 66 sets a short period TS as the period of the load signal (CIS-SH) to be input to the CIS 204 upon making leading end detection of a paper sheet. The CIS widthwise end detection long period setting unit 68 sets a long period TL as the period of the load signal (CIS-SH) to be input to the CIS 204 upon making widthwise end detection of a paper sheet. In this embodiment, this long period TL is six times the short period TS.

The leading end error detector 67 generates an error signal (ERR) when the leading end position of the paper sheet detected by the leading end detector 63 falls outside a predetermined range. Likewise, the widthwise end error detector 69 generates an error signal (ERR) when the widthwise end position of the paper sheet detected by the widthwise end detector 64 falls outside a predetermined range. The sequence end setting unit 70 is set with the count value of a sequence, which is used to determine the end of a print process for one paper sheet. The correction parameter storage unit 71 stores correction values of the forming start positions in the main scan and sub-scan directions, which are obtained by processes to be described later.

Figure 10:
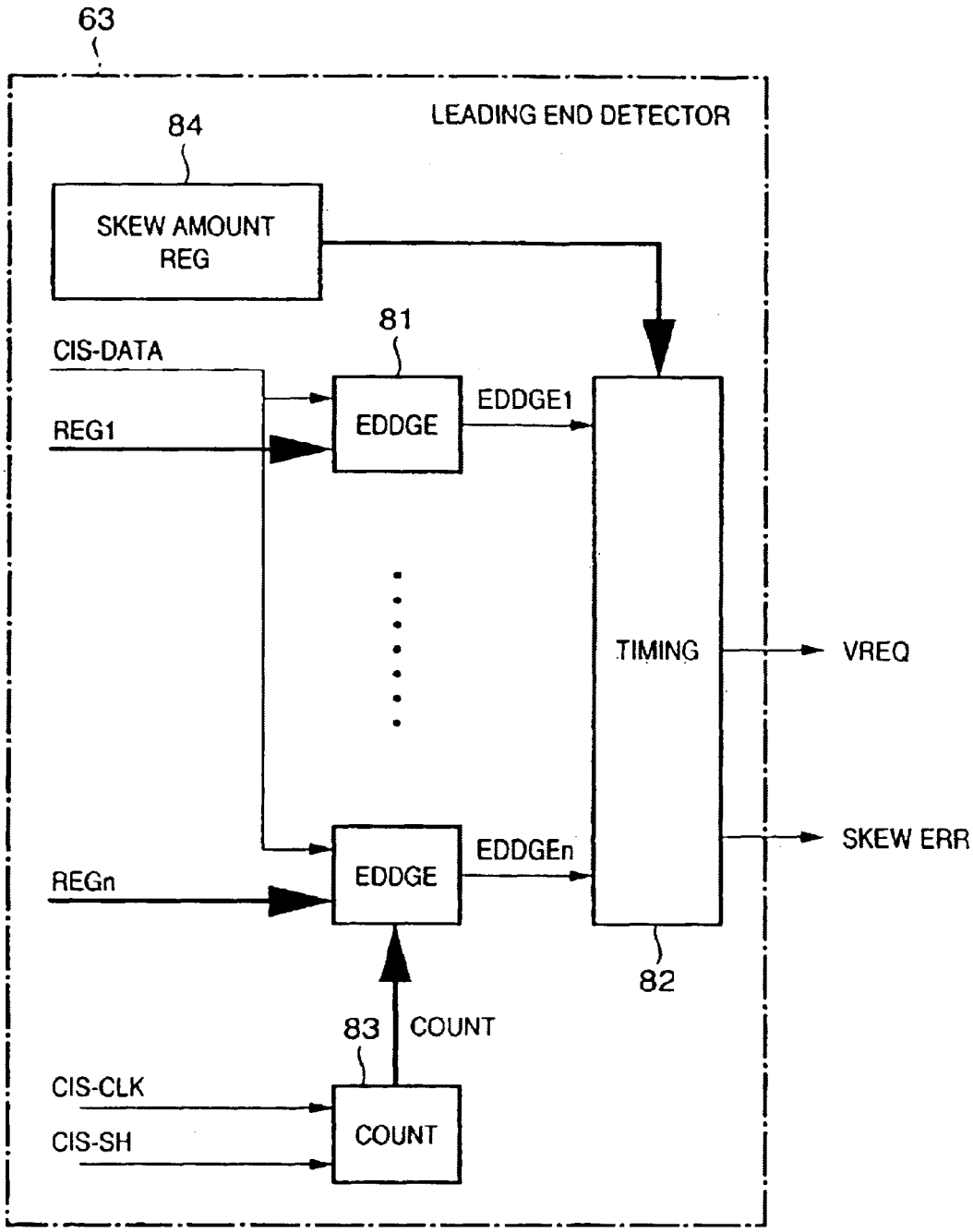
FIG. 10 is a block diagram showing the arrangement of a leading end detector 63.

FIG. 10 is a block diagram showing the arrangement of the leading end detector 63. The leading end detector 63 has a plurality of edge circuits (EDGE) 81, timing generation circuit 82, counter 83, and skew amount setting unit 84. Respective edge circuits (EDGE) 81 receive register signals (REG1 to REGn) which designate pixel positions in the light-receiving element unit 211*a* of the CIS 204 together with CIS data. When "absence of paper→presence of paper" is detected at the designated pixel position in synchronism with a count signal from the counter 83, that edge circuit (EDGE) 81 generates an edge signal (EDGE1 to n).

The timing generation circuit (TIMING) 82 outputs a leading end detection signal (VREQ) by averaging the plurality of generated edge (EDGE1 to n) signals, and detects a skew amount using the plurality of generated edge (EDGE1 to n) signals. When the detected skew amount is larger than a skew amount (REG) set in advance in the skew amount setting unit 84, the circuit 82 outputs a skew error signal (skew ERR). Note that details of the skew amount detection are not directly related to the present invention, and a description thereof will be omitted. Upon executing the leading end detection, a specific pixel alone may be used, but this embodiment uses a plurality of pixels to remove the influences of noise and the like. Since the leading end detection uses a plurality of pixels, the leading end detection precision can be improved compared to that obtained by a conventional single optical sensor or mechanical paper detection sensor.

Since the leading end detector detects the skew amount of a sheet on the basis of the data which are read out from the plurality of reading pixels and represent the leading end of the sheet, a calculation of the skew amount and the leading end position detection of the sheet can be executed at the same time, thus shortening the processing time.

Therefore, any skew can be accurately detected before an image is formed on a paper sheet, and a paper sheet on which an image with low print quality due to skew has been formed can be prevented from being output.

[Paper Feed/Image Forming Sequence]

Figure 11:
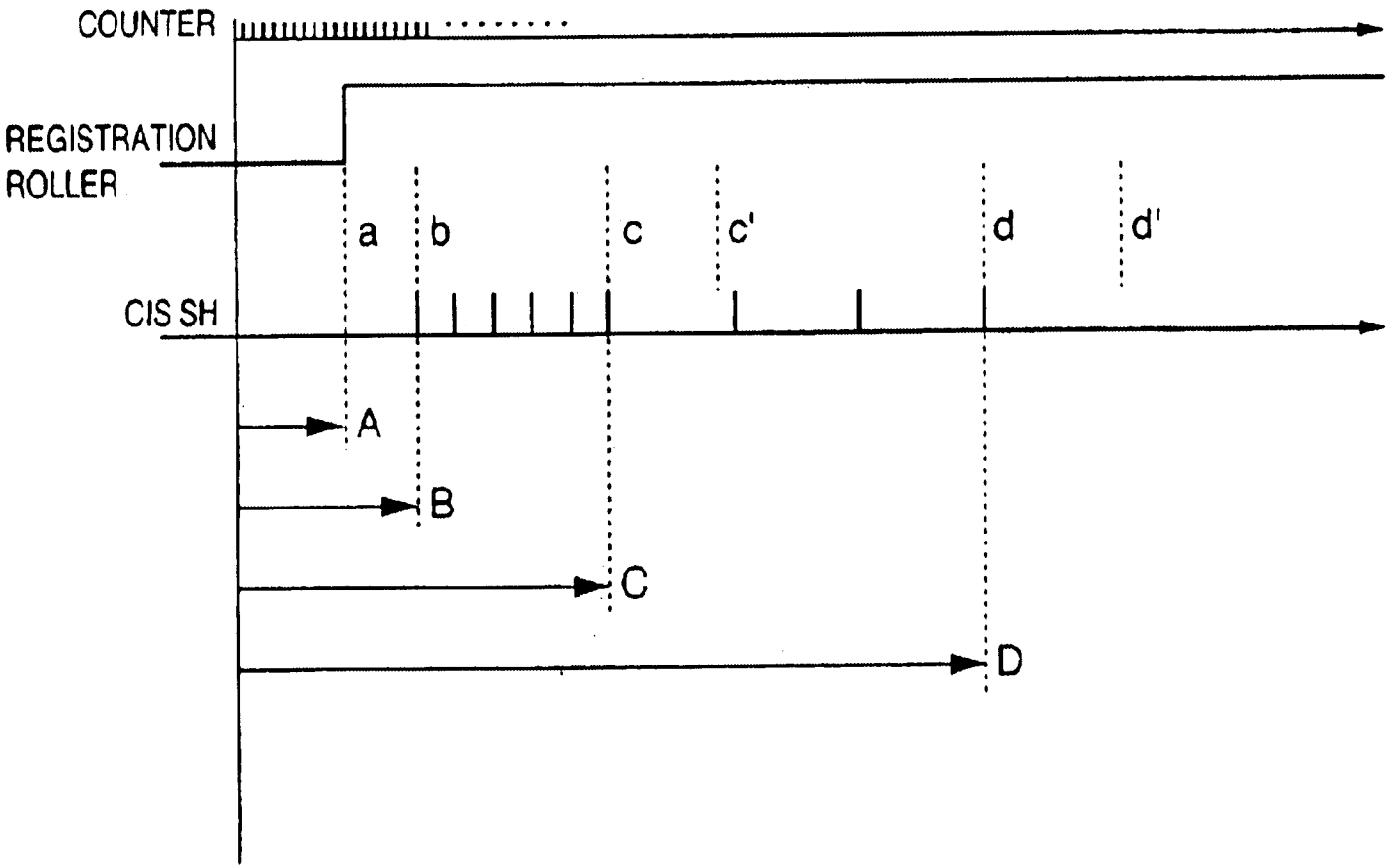
FIG. 11 is a timing chart showing the operation of the TCU 105.

FIG. 11 is a timing chart showing the operation of the TCU 105. The paper feed/image forming sequence of this embodiment starts while the paper sheet 107 is conveyed to the registration rollers 203 along the paper convey path 205, and stays at the position of the registration rollers 203. When a sequence start signal (SEQSTART) is input to the counter 61, the counter 61 starts to measure clocks for a predetermined period. When the count value of the counter 61 has reached timing a, the registration ON unit 62 sets a registration signal at H level to turn on, i.e., drive the registration rollers 203.

When the count value has reached timing b, the operation of a leading end detection mode in the CIS 204 starts. In the leading end detection mode, the TCU 105 outputs a load signal (CIS-SH) with the short period TS set in the CIS leading end detection short period setting unit 66 to the CIS 204. In response to this signal, the leading end detector 63 reads only CIS data from the light-receiving element unit 211*a* in the CIS 204.

Figure 12:
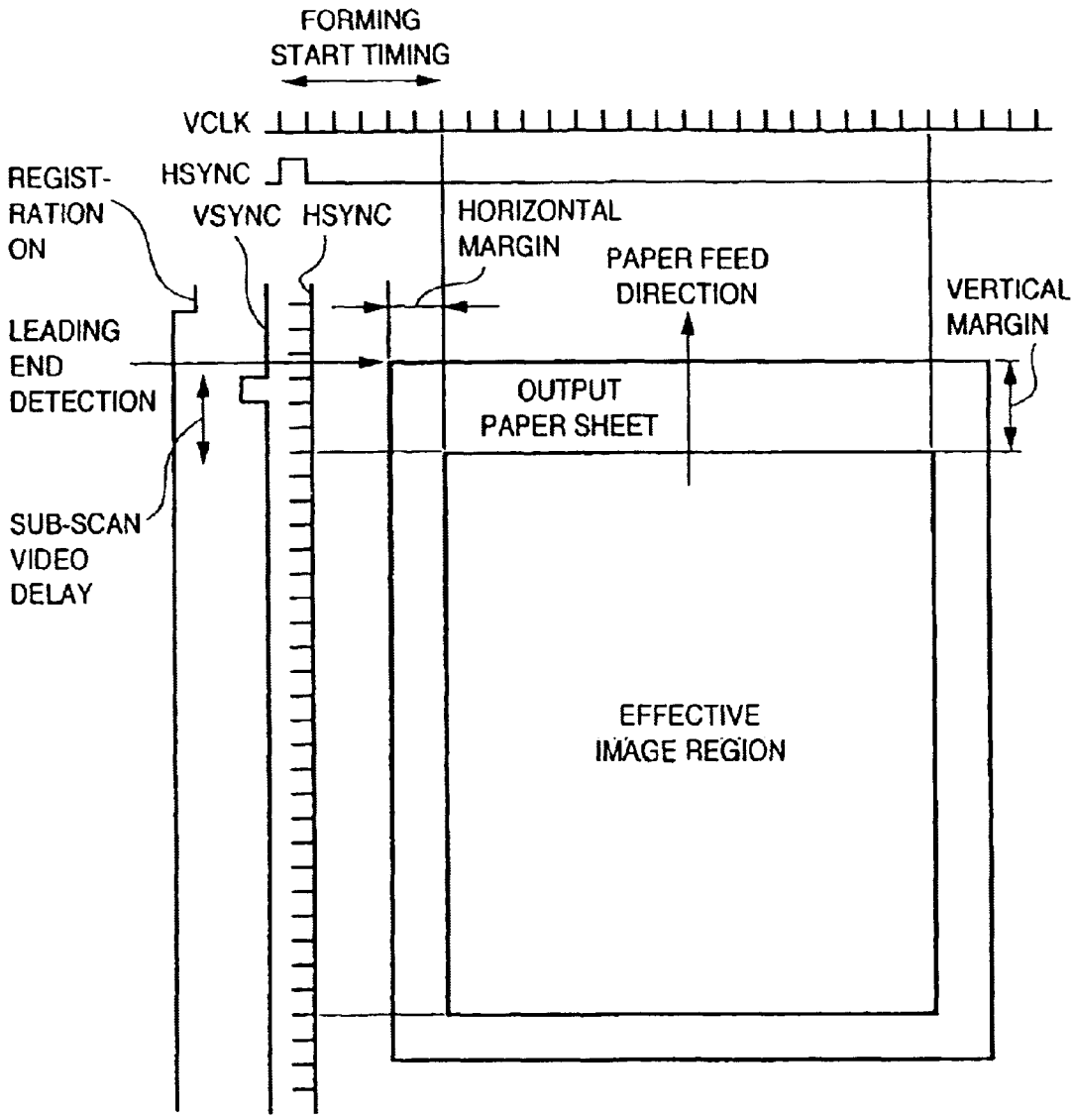
FIG. 12 is a view showing adjustment of a forming start position.

Upon detection of the leading end of the paper sheet when the count value has reached timing c, the leading end detector 63 outputs a leading end detection signal VREQ to the CIS controller 65, and starts the operation of a widthwise end detection mode in the CIS 204. When the CIS controller 65 outputs a vertical sync signal VSYNC corresponding to the leading end detection signal VREQ to the laser control circuit 127, the laser control circuit 127 adjusts the forming start position in the sub-scan direction in consideration of a vertical margin. FIG. 12 is a view showing adjustment of the forming start position. When no leading end position of the paper sheet is detected after the count value has reached timing c'(c'>c), the CIS controller 65 outputs a leading end error signal (leading end ERR).

In the widthwise end detection mode, the TCU 105 outputs a load signal (CIS-SH) with the long period TL set in the CIS widthwise end detection long period setting unit 68. In response to this signal, the widthwise end detector 64 reads only CIS data from the light-receiving element units 212*a* to 217*a* of a specific region in the CIS 204.

Upon detection of the widthwise end position of the paper sheet when the count value has reached timing d, the CIS controller 65 stops the operation of the CIS 204, and outputs a horizontal sync signal HSYNC and clocks VCLK to the laser control circuit 127. The laser control circuit 127 sets a forming start position in the main scan direction on the basis of the horizontal sync signal HSYNC and clocks VCLK (see FIG. 12). If no widthwise end position is detected after the count value has reached timing d', a widthwise end error signal (widthwise end ERR) is output.

[Adjustment Mode]

Figure 13:
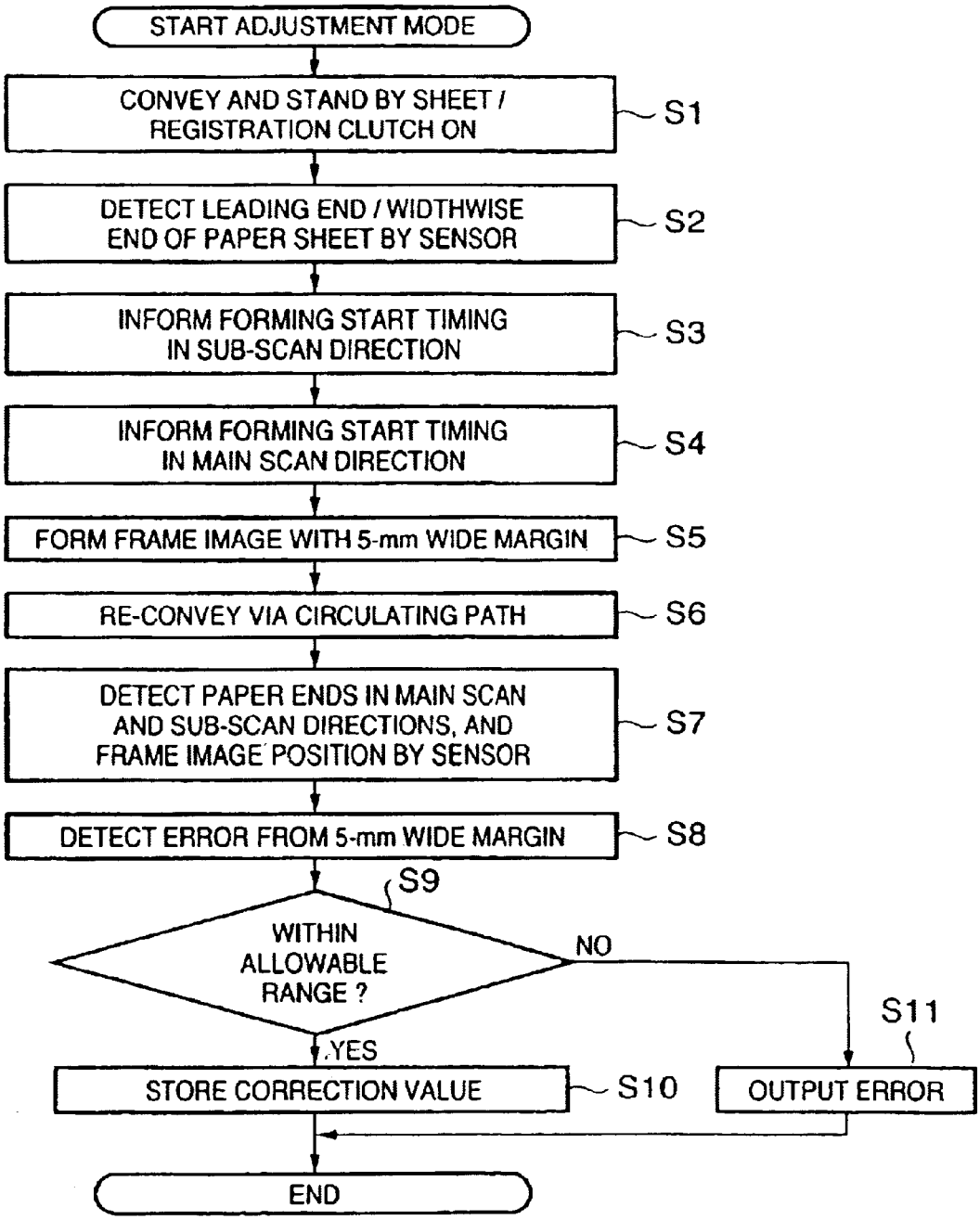
FIG. 13 is a flow chart showing an image position adjustment processing sequence in an adjustment mode.

An image position adjustment operation in an adjustment mode which is executed in an assembly process in a factory, upon exchanging the CIS by a service person, or when the positional precision of the CIS sensor and other conveyance-related components goes wrong due to a durability problem such as aging or the like will be explained below. FIG. 13 is a flow chart showing the image position adjustment processing sequence in the adjustment mode. When the adjustment mode of the image forming apparatus starts in accordance with an operation instruction of an assembly operator, the TCU 105 outputs the aforementioned timing signal, so as to control to feed the paper sheet 107 from a paper feed unit such as the cassette 34, 35, or the like, and to make it temporarily stay at the position of the registration clutch 203 (feed position) via the paper convey path 205. The TCU 105 then turns on the registration clutch 203 to convey the paper sheet 107 toward the developing unit side (step S1).

If the TCU 105 acquires the leading end and widthwise end positions of the paper sheet 107 detected by the CIS 204 (step S2), it informs the laser control circuit 127 of the forming start timing in the paper feed (sub-scan) direction on the basis of the distance L2 and paper convey speed between the CIS 204 and image forming point a (step S3) Furthermore, the TCU 105 informs the laser control circuit 127 of the forming start timing in the main scan direction on the basis of the distance (x+L3) as the sum of the distance L3 between the CIS 204 and BD detector 108, and the distance x from the lower end of the CIS 204 to the detected widthwise end position of the paper sheet 107 (step S4).

The laser control circuit 127 outputs a drive signal to the laser element 202 to form a frame image 210 set with 5-mm wide margins from the respective ends of the paper sheet 107 on the paper sheet 107 on the basis of the forming start timings in the main scan and sub-scan directions from the TCU 105 (step S5).

After that, the TCU 105 drives a convey roller (not shown) to convey the paper sheet 107 formed with the frame image 210 to the feed position again (step S6). That is, the paper sheet 107 reaches the paper convey path 205 via a circulating path 206 in place of the reverse path used in the double-sided image forming mode, and temporarily stays at the position of the registration clutch 203. The TCU 105 turns on the registration clutch 203 to feed the paper sheet 107 toward the photosensitive drum 31, and detects the paper end position and frame image position of the paper sheet 107 in the main scan and sub-scan direction using the CIS 204 (step S7). The TCU 105 calculates errors from respective 5-mm wide margins on the basis of the detected paper end position and frame image position (step S8).

The TCU 105 checks if the calculated errors fall within an allowable range (step S9). If the errors fall within the allowable range, the TCU 105 stores independent correction values in the main scan and sub-scan directions, which can cancel these errors, in the correction parameter storage unit 71 (step S10). After that, this process ends. The correction values stored in the correction parameter storage unit 71 in this way are used in forming start timing control upon executing an image forming operation based on a job (to be described later).

As a cause for errors of the frame image position generated upon second reading of the CIS 204 in step S7, sometimes the layout positions of components such as the laser device 202, transfer roller 39, CIS 204, BD detector 108, and the like slightly deviate from the distances L1, L2, and L3 as theoretical values upon mounting, and errors are generated in actual mounting dimensions. Therefore, it is determined in step S9 that errors within the allowable range are normal, and these errors are set as correction values, thus canceling the influences of the errors.

On the other hand, for errors which fall outside the allowable range, the building process itself is re-examined. Hence, if the errors calculated in step S9 fall outside the allowable range, an error is output to display a message that prompts the assembly operator to re-build components on the console of the image forming apparatus, on which an image forming mode of the image forming apparatus can be set and status data of the image forming apparatus can be displayed (step S11). After that, this process ends.

Detection of the paper end position and frame image position will be described in detail below. An image (frame) is formed in a predetermined procedure as in a normal print operation. Assume that image data is input in synchronism with VSYNC, and the VSYNC signal is generated after a paper leading end detection timing in order to determine a forming start position Y0 of an image in the sub-scan direction after the leading end detector 63 detects the leading end. On the basis of the theoretical dimensions of the mechanism, in order to start printing from a point with a leading end margin Y0, since a time difference Tv0 from the leading end detection timing to the VSYNC generation timing is known in advance, VSYNC is generated at that timing to adjust the sub-scan forming start position. Next, assume that main scan image adjustment is synchronized by a forming start signal, and the widthwise end detector 64 detects the paper end position. On the basis of the theoretical dimensions of the mechanism, in order to start printing from a point with a widthwise end margin X0, since a time difference T×0 from a BD signal as a main scan sync signal to the generation timing of the forming start signal is known in advance, the forming start signal is generated at that timing to adjust the main scan forming start position, thereby forming a frame line 210 shown in FIG. 2. Furthermore, the paper sheet formed with the frame line 210 is conveyed to the sensor 204 again by circulating it within the apparatus. The leading end detector 63 detects the leading end of the paper sheet formed with the frame line 210 in the same manner as a normal operation, and then detects the formed frame line 210. Then, SH signals of a CCD are counted to internally hold a line count value corresponding to the distance between the paper leading end and frame line, and the CPU reads the count value to detect an actual leading end margin amount Y. Likewise, the widthwise end detector 64 detects the widthwise end position and also detects the frame line position. Then, the CPU detects the difference between these positions to detect an actual main scan margin amount X. Differences Y1 and X1 between the distances of the detected leading end margin and widthwise end margin, and the 5-mm distance that should be recorded are detected. These values Y1 and X1 correspond to mounting errors of the detection element 204 with respect to mechanical theoretical values, and the CPU stores these values in a memory. After that, image formation is made using Y0+Y1 as a timing value Y2 in the sub-scan direction and X0+X1 as a timing value X2 in the main scan direction, as timing data upon forming an image.

Since the circulating path 206 in the double-sided image forming mode can be used to read a frame image, the operator need not re-set the paper sheet formed with the frame image on a paper feed cassette or manual insertion paper feed tray, and the user or service person need only set the adjustment mode to automatically correct any mounting errors of the CIS. Furthermore, since an image is formed using values, in which CIS mounting errors are corrected, in a normal mode to be described later, the precision of the image forming position can be improved.

Since it is checked if the CIS mounting errors fall within the allowable range, an image forming apparatus that suffers defective mounting can be distinguished from a normal image forming apparatus, thus improving the productivity upon assembly or preventing defective mounting upon exchanging the CIS.

Furthermore, when the CIS mounting errors fall outside the allowable range, an error is output to display a message that prompts the assembly operator to re-build components. Hence, since defective mounting can be immediately recognized in an assembly process in a factory or upon exchanging the CIS by a service person, defective mounting can be quickly eliminated.

[Normal Mode]

Figure 14:
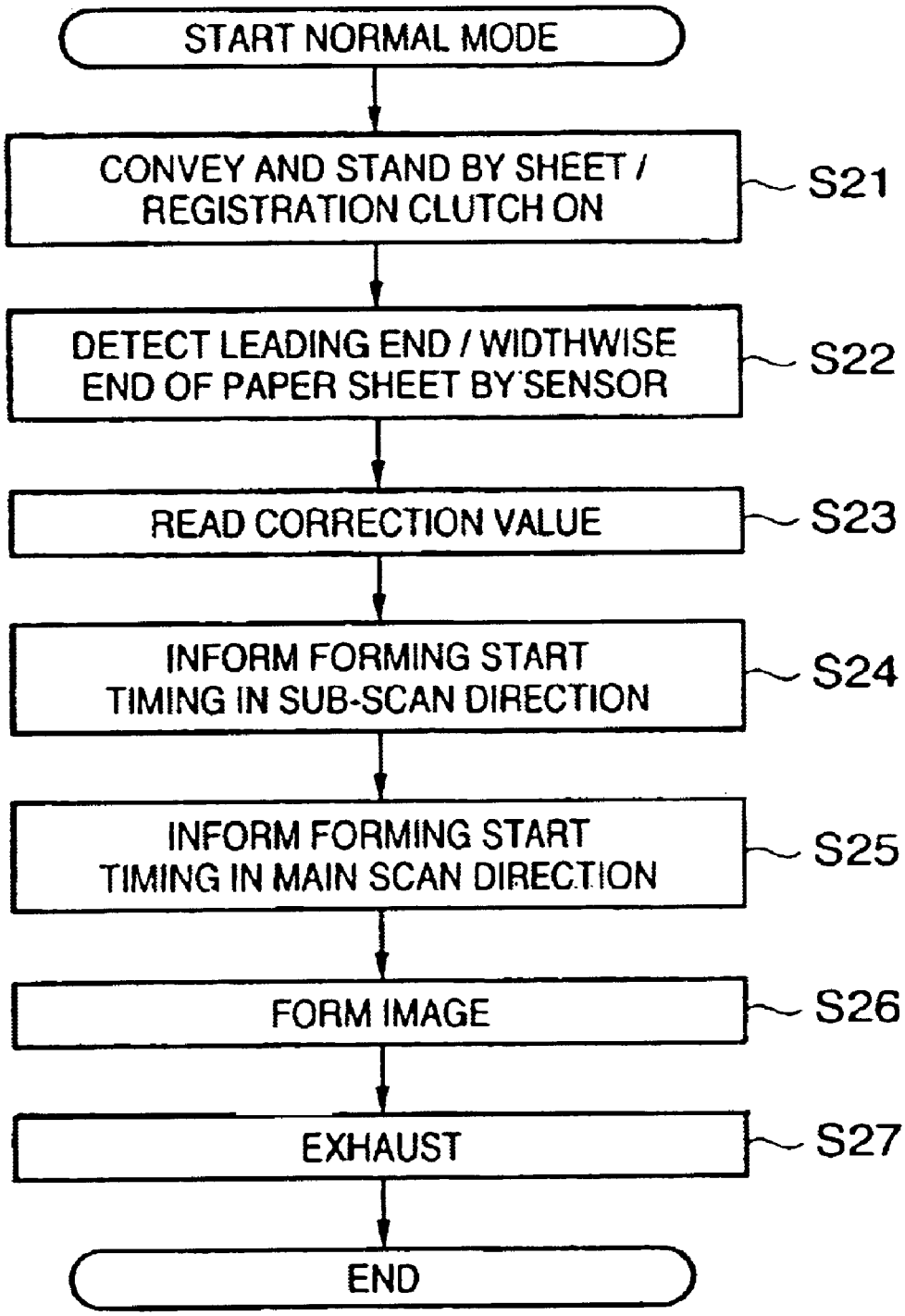
FIG. 14 is a flow chart showing an image forming processing sequence in a normal mode.

FIG. 14 is a flow chart showing the image forming processing sequence in the normal mode. When an image forming operation in the normal mode starts in response to an operator's operation, the TCU 105 outputs the aforementioned timing signal so as to control to feed the paper sheet 107 from a paper feed unit such as the cassette 34, 35, or the like, and to make it temporarily stay at the position of the registration clutch 203 (feed position) via the paper convey path 205. The TCU 105 then turns on the registration clutch 203 to convey the paper sheet 107 toward the developing unit side (step S21).

If the TCU 105 acquires the leading end and widthwise end positions of the paper sheet 107 detected by the CIS 204 (step S22), it reads the correction values, which are obtained as a result of execution of the aforementioned adjustment mode, and are stored in the correction parameter storage unit 71 (step S23). Then, the TCU 105 informs the laser control circuit 127 of the forming start timing in the paper feed (sub-scan) direction on the basis of the distance L2 between the CIS 204 and image forming point a, and the read correction value in the sub-scan direction (step S24). Furthermore, the TCU 105 informs the laser control circuit 127 of the forming start timing in the main scan direction on the basis of the distance (x+L3) as the sum of the distance L3 between the CIS 204 and BD detector 108, and the distance x from the lower end of the CIS 204 to the widthwise end position of the paper sheet, and the correction value in the main scan direction read in step S23 (step S25).

The laser control circuit 127 outputs a drive signal based on a job to the laser element 202 to form an image on the paper sheet 107 on the basis of the forming start timing signals in the main scan and sub-scan directions from the TCU 105 (step S26). Upon completion of image formation, the TCU 105 exhausts the paper sheet 107 toward the finisher (step S27), thus ending this process.

In the normal mode, since the correction parameters stored in the correction parameter storage unit 71 in the adjustment mode are used, and an image is recorded on a paper sheet by adding them to leading end detection data or widthwise end detection data as mounting error data, the need for calculating correction parameters for each print process can be obviated, and image recording with very high positional precision can be realized.

[Execution Timing of Adjustment Mode]

Figure 15:
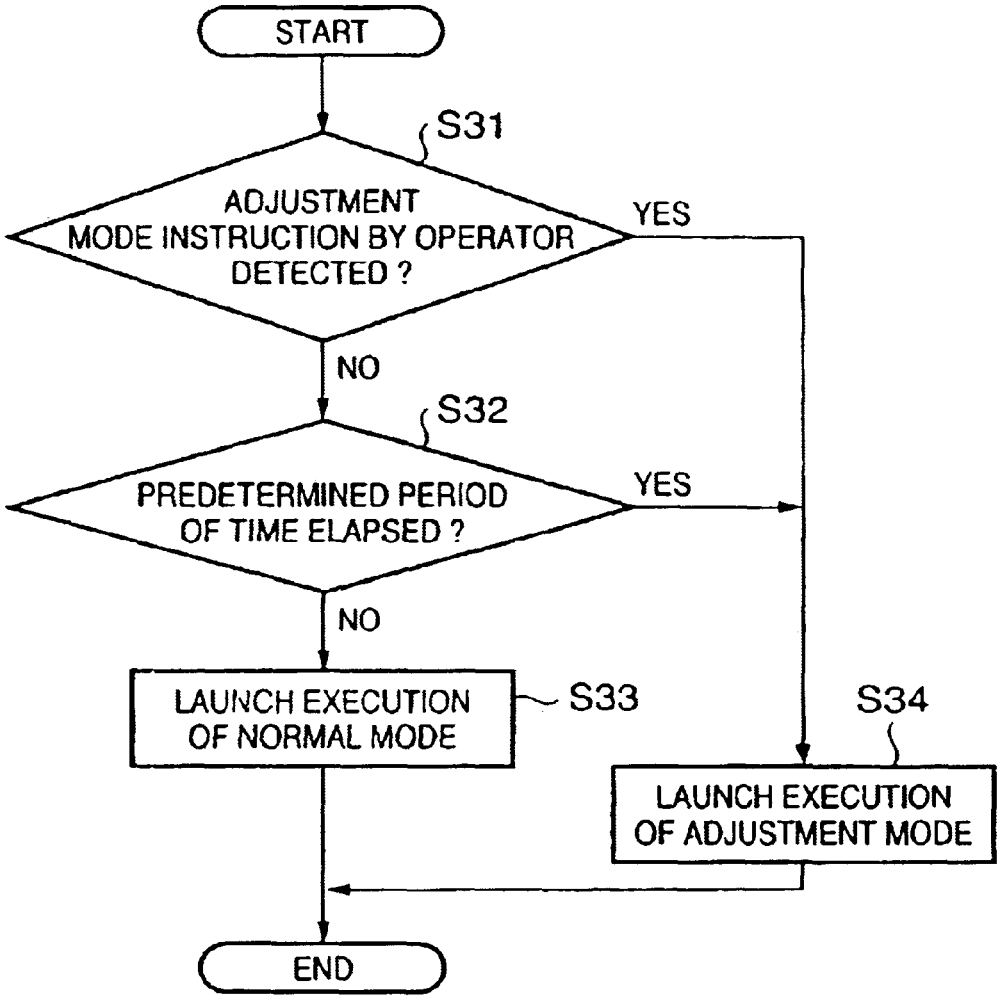
FIG. 15 is a flow chart showing a processing sequence for determining the execution timing of the adjustment mode.
Figure 16:
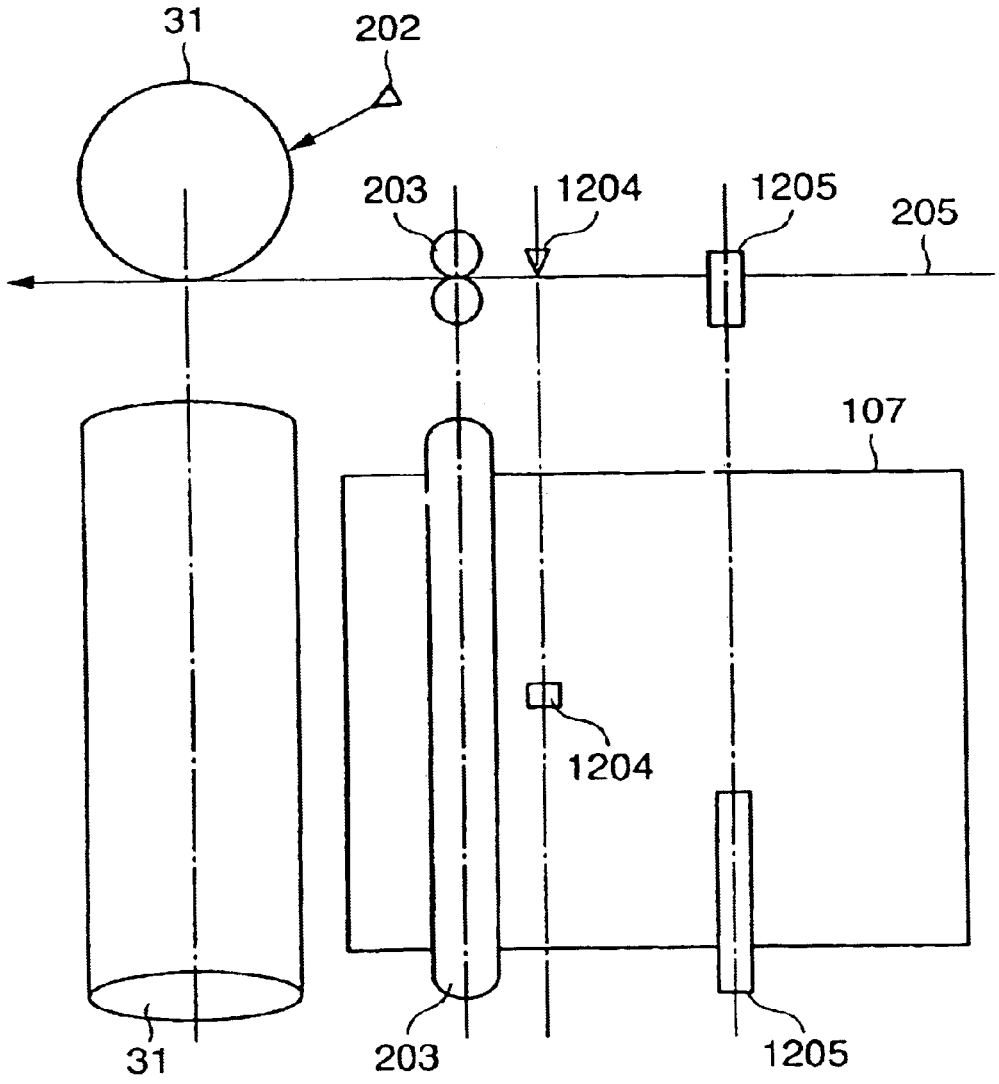
FIG. 16 is a view showing the structure of a print position adjustment mechanism in a conventional image forming apparatus.

FIG. 15 is a flow chart showing a processing sequence for determining the execution timing of the adjustment mode. This process is repetitively executed by a CPU (not shown) in the control circuit 51 or the TCU 105 at predetermined time intervals. It is checked if the operator has issued an execution instruction of the adjustment mode at a control panel (step S31). If the operator has issued an execution instruction of the adjustment mode, execution of the adjustment mode is launched (step S34). This adjustment mode execution process corresponds to the process shown in FIG. 13 mentioned above. After that, this process ends.

On the other hand, if an execution instruction of the adjustment mode by the operator is not detected in step S31, it is checked if a predetermined period of time has elapsed since the last execution of the adjustment mode (step S32). Note that it is determined that re-adjustment should be executed in consideration of limited durability of an apparatus if the predetermined period of time has elapsed. Note that this predetermined period of time may be arbitrarily set by the operator on the control panel. If the predetermined period of time has elapsed, execution of the adjustment mode is launched in step S34. On the other hand, if the predetermined period of time has not elapsed yet, execution of the normal mode is launched (step S33), thus ending this process. The normal mode execution process corresponds to the process shown in FIG. 14 mentioned above.

Since the adjustment mode can be executed based on operator's input, timely attachment error adjustment can be done upon attachment or exchange of the CIS. Also, since the operator can designate the execution timing of the adjustment mode, attachment error adjustment due to aging or the like can be made. Therefore, an accurate image position can always be maintained.

As described above, according to the image forming apparatus of this embodiment, after a frame image is formed on a paper sheet on the basis of the leading end and widthwise end positions of the paper sheet detected by the CIS in the adjustment mode, that paper sheet is circulated, and the frame image position formed on the paper sheet is detected by the CIS again to store correction values that can cancel any errors found. Then, the forming start timing control is done using these correction values upon forming an image on the basis of an actual job, thereby detecting the paper feed timing with high precision, and eliminating deterioration of the image position precision due to mounting errors and durability of components. In this way, the image position can be adjusted with high precision.

The embodiment of the present invention has been explained. However, the present invention is not limited to the arrangement of such specific embodiment, and can be applied to any other arrangements as long as they can implement functions described in the scope of the claims or functions of the arrangement of the embodiment.

For example, in the above embodiment, after the timings in the main scan and sub-scan directions are detected, these timing signals are sent to the TCU 105. However, adjustment of the forming start timings after detection is not particularly limited, and an arbitrary adjustment method may be used.

The image forming timing in the sub-scan direction is determined by detecting the paper leading end. Alternatively, that image forming timing may be determined by detecting the paper trailing end by the CIS depending on the mechanical arrangement of an apparatus.

Furthermore, in the above embodiment, upon execution of the adjustment mode in a factory, a frame image with 5-mm wide margins in the main scan and sub-scan directions of a paper sheet is formed on the paper sheet. However, the margin value is not limited to 5 mm, but may be an appropriate value, as a matter of course. An image to be formed in the adjustment mode is not limited to the frame image, and any other images such as a grid image, circle image, and the like may be formed.

In the above embodiment, the adjustment mode is executed every time the predetermined period of time has elapsed, in consideration of the durability of an apparatus. In this case, the adjustment mode may be executed every time a predetermined of number of pages are output in addition to an elapse of a predetermined number of days and time.

The present invention can be applied to a system constituted by a plurality of devices (e.g., host computer, interface, reader, printer) or to an apparatus comprising a single device (e.g., copying machine, facsimile machine)

Further, the object of the present invention can also be achieved by providing a storage medium storing program codes for performing the aforesaid processes to a computer system or apparatus (e.g., a personal computer), reading the program codes, by a CPU or MPU of the computer system or apparatus, from the storage medium, then executing the program.

In this case, the program codes read from the storage medium realize the functions according to the described embodiments and the storage medium storing the program codes constitutes the invention.

Further, the storage medium, such as a floppy disk, a hard disk, an optical disk, a magneto-optical disk, CD-ROM, CD-R, a magnetic tape, a non-volatile type memory card, and ROM can be used for providing the program codes.

Furthermore, besides aforesaid functions according to the above described embodiments are realized by executing the program codes which are read by a computer, the present invention includes a case where an OS (operating system) or the like working on the computer performs a part or entire processes in accordance with designations of the program codes and realizes functions according to the above described embodiments.

Furthermore, the present invention also includes a case where, after the program codes read from the storage medium are written in a function expansion card which is inserted into the computer or in a memory provided in a function expansion unit which is connected to the computer, CPU or the like contained in the function expansion card or unit performs a part or entire process in accordance with designations of the program codes and realizes functions of the above described embodiments.

In a case where the present invention is applied to the aforesaid storage medium, the storage medium stores program codes corresponding to the flowcharts described in the embodiments.

The present invention is not limited to the above embodiments and various changes and modifications can be made within the spirit and scope of the present invention. Therefore to apprise the public of the scope of the present invention, the following claims are made.

It is thus believed that the operation and construction of the present invention will be apparent from the foregoing description. While the method, apparatus and system shown and described has been characterized as being preferred, it will be readily apparent that various changes and modifications could be made therein without departing from the scope of the invention as defined in the following claims.

What is claimed is:

1. An image forming apparatus comprising:

an image forming unit for forming an image on a sheet;

registration rollers for conveying the sheet to said image forming unit at a predetermined timing;

a sheet reading unit which has a plurality of reading pixels used to read an image on the sheet, and is arranged on a passage region of the sheet between said image forming unit and said registration rollers so that the plurality of reading pixels line up in a widthwise direction of the sheet;

a leading end detector for detecting a leading end of the sheet by repetitively reading out the plurality of pixels at a predetermined period;

a start timing determination unit for determining a start timing of image formation of said image forming unit on the basis of the leading end of the sheet detected by said leading end detector;

a re-convey unit for making said image forming unit form a predetermined image on the sheet in accordance with the start timing of image formation determined by said start timing determination unit, and re-conveying the sheet formed with the predetermined image to said image forming unit;

an image position detector for detecting a predetermined image position-formed on the sheet re-conveyed by said re-convey unit by reading out the reading pixels of said sheet reading unit;

a correction value calculation unit for calculating a correction value of the start timing of image formation in the convey direction on the basis of the image position detected by said image position detector; and a forming start position adjustment unit for adjusting a position of an image to be formed on the sheet by said image forming unit by correcting the start timing of image formation in the convey direction on the basis of the correction value calculated by said correction value calculation unit.

2. An image forming apparatus comprising:

an image forming unit for forming an image of a document on a sheet;

registration rollers for conveying the sheet to said image forming unit at a predetermined timing;

a sheet reading unit which has a plurality of reading pixels used to read an image on the sheet, and is arranged on a passage region of the sheet between said image forming unit and said registration rollers so that the plurality of reading pixels line up in a widthwise direction of the sheet;

a leading end detector for detecting a leading end of the sheet by repetitively reading out the plurality of pixels at a predetermined period;

a start timing determination unit for determining a start timing of image formation of said image forming unit on the basis of the leading end of the sheet detected by said leading end detector;

a widthwise end detector for detecting a widthwise end of the sheet by repetitively reading out the plurality of reading pixels;

a forming start position determination unit for determining a forming start position of the image in a direction perpendicular to a convey direction of the sheet by said image forming unit on the basis of the detected widthwise end of the sheet;

a re-convey unit for making said image forming unit form a predetermined image on the sheet in accordance with the determined start timing of image formation, and the determined forming start position of the image, and re-conveying the sheet formed with the predetermined image to said image forming unit;

an image position detector for detecting a predetermined image position formed on the sheet re-conveyed by said re-convey unit by reading out the reading pixels of said sheet reading unit;

a correction value calculation unit for calculating correction values of the start timing of image formation and the forming start position of the image on the basis of the image position detected by said image position detector; and a forming start position adjustment unit for adjusting a position of an image to be formed on the sheet by said image forming unit by correcting the start timing of image formation and the forming start position of the image on the basis of the correction values calculated by said correction value calculation unit.

3. An image forming apparatus according to claim 2, further comprising a determining unit for determining if the detected predetermined image position falls within an allowable range, and wherein when the detected predetermined image position falls within the allowable range, said determining unit makes said correction value calculation unit calculate the correction value, and when the detected predetermined image position falls outside the allowable range, said determining unit outputs an error.

4. An image forming apparatus according to claim 3, further comprising a display unit for displaying status of said image forming apparatus, and wherein when said determining unit determines that the detected predetermined image position falls outside the allowable range, a warning that indicates defective mounting of said sheet reading unit is displayed on said display unit.

5. An image forming apparatus according to claim 2, wherein when an operator issues an adjustment mode execution instruction, said image forming unit, said re-convey unit, said image position detector, said correction value calculation unit, and said image position adjustment unit are executed.

6. An image forming apparatus according to claim 2, wherein when a predetermined period of time has elapsed since previous calculation of the correction value, said image forming unit, said re-convey unit, said image position detector, said correction value calculation unit, and said image position adjustment unit are executed.

7. An image forming apparatus according to claim 2, further comprising a correction value storage unit for storing the calculated correction values.

8. An image forming apparatus according to claim 2, wherein the predetermined image is a frame image formed with margins from respective end portions of the sheet.

9. An image forming apparatus according to claim 2, wherein said leading end detector repetitively reads out some of the plurality of reading pixels.

10. An image forming apparatus according to claim 2, wherein said widthwise end detector repetitively reads out some of the plurality of reading pixels at a period longer than the predetermined period.

11. An image forming apparatus according to claim 2, wherein said widthwise end detector detects the widthwise end of the sheet after said leading end detector detects the leading end of the sheet.

12. An image forming apparatus according to claim 2, wherein said sheet reading unit has a reading width larger than a value which is ½ a value obtained by subtracting a minimum width of the sheet used in said image forming unit from a maximum width of the sheet used in said image forming unit.

13. An image forming apparatus according to claim 2, wherein said start timing determination unit determines a forming start timing of a laser in the convey direction to an image carrier, and said forming start position determination unit sets a forming start position of the laser in a direction perpendicular to the convey direction to the image carrier.

14. An image forming apparatus according to claim 13, wherein a distance between said sheet reading unit and a transfer position where a developing unit transfers an electrostatic latent image on the sheet contains at least a distance obtained by adding a circumferential distance on the image carrier from a position on the image carrier which is irradiated with the laser from the laser device to the transfer position, and a distance corresponding to a time required from when the plurality of reading pixels begin to read the sheet until a start timing of the irradiation and the forming start position are set.

15. An image formation control method for an image forming apparatus, which comprises an image forming unit for forming an image on a sheet, registration rollers for conveying the sheet to said image forming unit at a predetermined timing, and a sheet reading unit which has a plurality of reading pixels used to read an image on the sheet, and is arranged on a passage region of the sheet between said image forming unit and said registration rollers so that the plurality of reading pixels line up in a widthwise direction of the sheet, comprising the steps of:

detecting a leading end of the sheet by repetitively reading out the plurality of pixels at a predetermined period;

determining a start timing of image formation of said image forming unit on the basis of the detected leading end of the sheet;

making said image forming unit form a predetermined image on the sheet in accordance with the determined start timing of image formation;

re-conveying the sheet formed with the predetermined image to said image forming unit;

detecting a predetermined image position formed on the re-conveyed sheet by reading out the reading pixels of said sheet reading unit;

calculating a correction value of the start timing of image formation in the convey direction on the basis of the detected image position; and adjusting a position of an image to be formed on the sheet by said image forming unit by correcting the start timing of image formation in the convey direction on the basis of the calculated correction value.

16. An image formation control method for an image forming apparatus, which comprises an image forming unit for forming an image on a sheet, registration rollers for conveying the sheet to said image forming unit at a predetermined timing, and a sheet reading unit which has a plurality of reading pixels used to read an image on the sheet, and is arranged on a passage region of the sheet between said image forming unit and said registration rollers so that the plurality of reading pixels line up in a widthwise direction of the sheet, comprising the steps of:

detecting a leading end of the sheet by repetitively reading out the plurality of pixels at a predetermined period;

determining a start timing of image formation of said image forming unit on the basis of the detected leading end of the sheet;

detecting a widthwise end of the sheet by repetitively reading out the plurality of reading pixels;

determining a forming start position of the image in a direction perpendicular to a convey direction of the sheet on the basis of the detected widthwise end of the sheet;

making said image forming unit form a predetermined image on the sheet in accordance with the determined start timing of image formation and the determined forming start position of the image;

re-conveying the sheet formed with the predetermined image to said image forming unit;

detecting a predetermined image position formed on the re-conveyed sheet by reading out the reading pixels of said sheet reading unit;

calculating correction values of the start timing of image formation and the forming start position of the image on the basis of the detected predetermined image position; and adjusting a position of an image to be formed on the sheet by said image forming unit by correcting the start timing of image formation and the forming start position of the image on the basis of the calculated correction values.

17. An image formation control method according to claim 16, wherein the leading end detection step includes the step of repetitively reading out some of the plurality of reading pixels.

18. An image formation control method according to claim 16, wherein the widthwise end detection step includes the step of repetitively reading out some of the plurality of reading pixels at a period longer than the predetermined period.

19. An image formation control method according to claim 16, wherein the widthwise end detection step is executed after the leading end detection step is executed.

* * * * *

UNITED STATES PATENT AND TRADEMARK OFFICE

CERTIFICATE OF CORRECTION

PATENT NO. : 6,934,504 B2
DATED : August 23, 2005
INVENTOR(S) : Tetsuya Morita

It is certified that error appears in the above-identified patent and that said Letters Patent is hereby corrected as shown below:

Column 1,
Line 43, "9-219776)" should read -- 9-219776). --.

Column 3,
Line 6, "by-the" should read -- by the --.

Column 16,
Line 25, "are realized" should read -- being realized --.

Signed and Sealed this

Second Day of May, 2006

JON W. DUDAS
*Director of the United States Patent and Trademark Office*